US010995475B2

(12) United States Patent
Hijikata et al.

(10) Patent No.: US 10,995,475 B2
(45) Date of Patent: May 4, 2021

(54) CONSTRUCTION MACHINE

(71) Applicant: Hitachi Construction Machinery Co., Ltd., Tokyo (JP)

(72) Inventors: Seiji Hijikata, Tsukuba (JP); Yasutaka Tsuruga, Ryugasaki (JP); Kouji Ishikawa, Kasumigaura (JP); Kiwamu Takahashi, Moriyama (JP); Masatoshi Hoshino, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/491,264

(22) PCT Filed: May 18, 2018

(86) PCT No.: PCT/JP2018/019334
§ 371 (c)(1),
(2) Date: Sep. 5, 2019

(87) PCT Pub. No.: WO2019/049435
PCT Pub. Date: Mar. 14, 2019

(65) Prior Publication Data

US 2020/0032485 A1 Jan. 30, 2020

(30) Foreign Application Priority Data

Sep. 11, 2017 (JP) ..... JP2017-174062

(51) Int. Cl.
*E02F 9/22* (2006.01)
*F15B 11/08* (2006.01)
*F15B 21/14* (2006.01)

(52) U.S. Cl.
CPC ..... *E02F 9/2217* (2013.01); *E02F 9/2232* (2013.01); *E02F 9/2267* (2013.01); *F15B 11/08* (2013.01); *F15B 21/14* (2013.01)

(58) Field of Classification Search
CPC ..... E02F 9/2217; E02F 9/2232; E02F 9/2267; F15B 21/14
(Continued)

(56) References Cited

U.S. PATENT DOCUMENTS

2017/0241445 A1* 8/2017 Shang ..... F15B 1/04
2017/0284064 A1 10/2017 Hijikata et al.

FOREIGN PATENT DOCUMENTS

CN 202081450 U 12/2011
CN 106574647 A 4/2017
(Continued)

OTHER PUBLICATIONS

International Search Report (PCT/ISA/210) issued in PCT Application No. PCT/JP2018/019334 dated Aug. 21, 2018 with English translation (five (5) pages).
(Continued)

*Primary Examiner* — Abiy Teka
*Assistant Examiner* — Daniel S Collins
(74) *Attorney, Agent, or Firm* — Crowell & Moring LLP

(57) ABSTRACT

A hydraulic circuit (11) of a hydraulic excavator (1) is provided with a main hydraulic circuit (11A) including a boom cylinder (5D), a pilot hydraulic circuit (11B) for operating the boom cylinder (5D) and a recovery hydraulic circuit (11C) including an accumulator (29). In this case, the recovery hydraulic circuit (11C) is provided with a recovery control valve (31) that recovers pressurized oil discharged from the boom cylinder (5D) to the accumulator (29), a main supply control valve (34) for supplying pressurized oil accumulated in the accumulator (29) to the main hydraulic circuit (11A) and a pilot supply control valve (37) for supplying pressurized oil accumulated in the accumulator (29) to the pilot hydraulic circuit (11B).

13 Claims, 15 Drawing Sheets

(58) Field of Classification Search
USPC ..... 60/413
See application file for complete search history.

(56) References Cited

FOREIGN PATENT DOCUMENTS

| | | | |
|---|---|---|---|
| JP | 10-231805 | A | 9/1998 |
| JP | 2009-250361 | A | 10/2009 |
| JP | 2011-69432 | A | 4/2011 |
| JP | 2012-13156 | A | 1/2012 |
| JP | 2014-206253 | A | 10/2014 |
| JP | 2017-61795 | A | 3/2017 |
| WO | WO 2013/059020 | A1 | 4/2013 |
| WO | WO 2016/147283 | A1 | 9/2016 |

OTHER PUBLICATIONS

Japanese-language Written Opinion (PCT/ISA/237) issued in PCT Application No. PCT/JP2018/019334 dated Aug. 21, 2018 (five (5) pages).
Chinese-language Office Action issued in Chinese Application No. 201880015157.8 dated Mar. 27, 2020 with English translation (11 pages).
Japanese-language Office Action issued in Japanese Application No. 2017-174062 dated Apr. 28, 2020 with English translation (10 pages).
Supplementary European Search Report issued in European Application No. 18853247.7 dated Nov. 19, 2020 (8 pages).

* cited by examiner

CONSTRUCTION MACHINE

TECHNICAL FIELD

The present invention relates to a construction machine such as a hydraulic excavator, a hydraulic crane, a wheel loader, and the like.

BACKGROUND ART

Patent Document 1 discloses a construction machine in which return oil from a hydraulic cylinder is recovered into an accumulator and the recovered pressurized oil is supplied to a pilot line to achieve regeneration of energy.

PRIOR ART DOCUMENT

Patent Document

Patent Document 1: Japanese Patent Laid-Open No. 2009-250361 A

SUMMARY OF THE INVENTION

In typical hydraulic excavators, a directional control valve for controlling a flow rate and a flow direction of highly pressurized oil is mounted between a hydraulic cylinder and a hydraulic source including a main pump and a tank. The directional control valve is operated by a low pilot-pressure. That is, the directional control valve has a spool which is switched by the low pilot-pressure. In this case, the directional control valve (a hydraulic pilot part thereof) is subjected to pressurized oil (a pilot pressure) from a pilot pump through an operating device which is operated by an operator. The pilot pump consumes power (fuel) of an engine for generating the pilot pressure.

On the other hand, in the construction machine disclosed in Patent Document 1, when the pressurized oil accumulated in an accumulator is supplied to the pilot line, an electric motor for rotationally driving the pilot pump is stopped, making it possible to suppress the delivery of the pilot pump. Thereby, the power of the pilot pump can be reduced. For example, in a case where the pilot pump is configured to be driven by the engine, the fuel consumption of the engine can be reduced.

However, in the construction machine disclosed in Patent Document 1, when the highly pressurized oil from the hydraulic cylinder is supplied to the pilot line under a low pressure through the accumulator and a pressure supply valve, there is a large pressure difference among them. Because of this, the pressure loss in the pressure supply valve may possibly increase. In turn, the energy (pressurized oil) recovered from the hydraulic cylinder may possibly not be efficiently (effectively) utilized.

It is an object of the present invention to provide a construction machine capable of efficiently utilizing recovered energy in the configuration in which return oil from a hydraulic cylinder is regenerated in a pilot line.

A construction machine according to the present invention including a main hydraulic pump that delivers pressurized oil to a main hydraulic circuit including a hydraulic actuator, a pilot hydraulic pump that delivers pressurized oil to a pilot hydraulic circuit to operate the hydraulic actuator, and an accumulator that accumulates pressurized oil discharged from the hydraulic actuator, characterized in that the construction machine includes a recovery device that recovers the pressurized oil discharged from the hydraulic actuator into the accumulator, a main circuit supply device that supplies pressurized oil accumulated in the accumulator to the main hydraulic circuit, and a pilot circuit supply device that supplies the pressurized oil accumulated in the accumulator to the pilot hydraulic circuit.

According to the present invention, in the configuration in which the return oil (the pressurized oil) from the hydraulic actuator is regenerated in the pilot hydraulic circuit, the recovered energy can be efficiently utilized. Specifically, the output of the pilot hydraulic pump can be reduced by the return oil from the hydraulic actuator (the pressurized oil recovered into the accumulator). In addition to this, the pressurized oil in the accumulator is returned also to the main hydraulic circuit under a high pressure, and thereby, enabling efficient utilization of energy.

MODE FOR CARRYING OUT THE INVENTION

Hereinafter, an explanation will be in detail made of embodiments of a construction machine according to the present invention by taking a case where the present invention is applied to a hydraulic excavator as an example with reference to the accompanying drawings. Incidentally, letter "S" is used to represent each step in the flow charts shown in FIGS. 3, 5, 7, 9, 11, 12, 15 (for example, step 1="S1")

Figure 1:
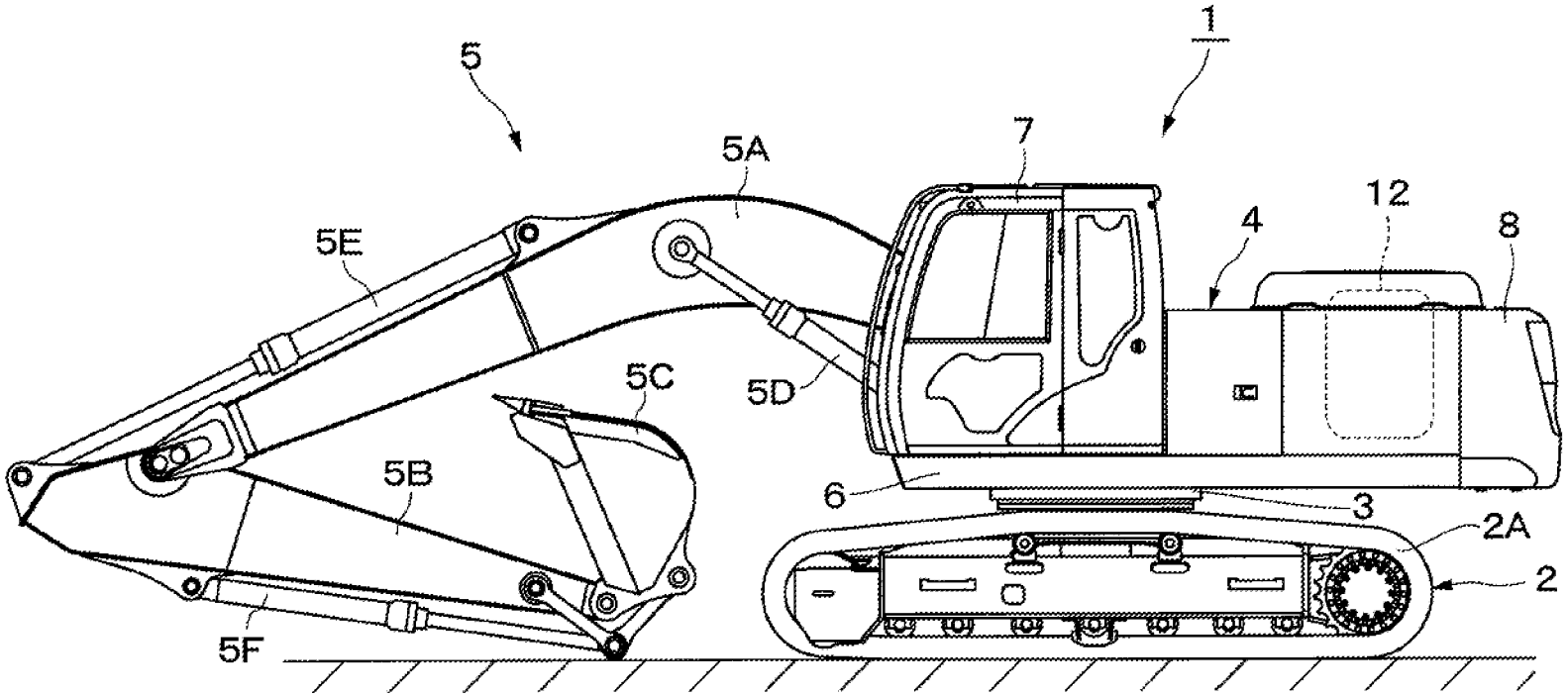
FIG. 1 is a front view showing a hydraulic excavator according to an embodiment.
Figure 2:
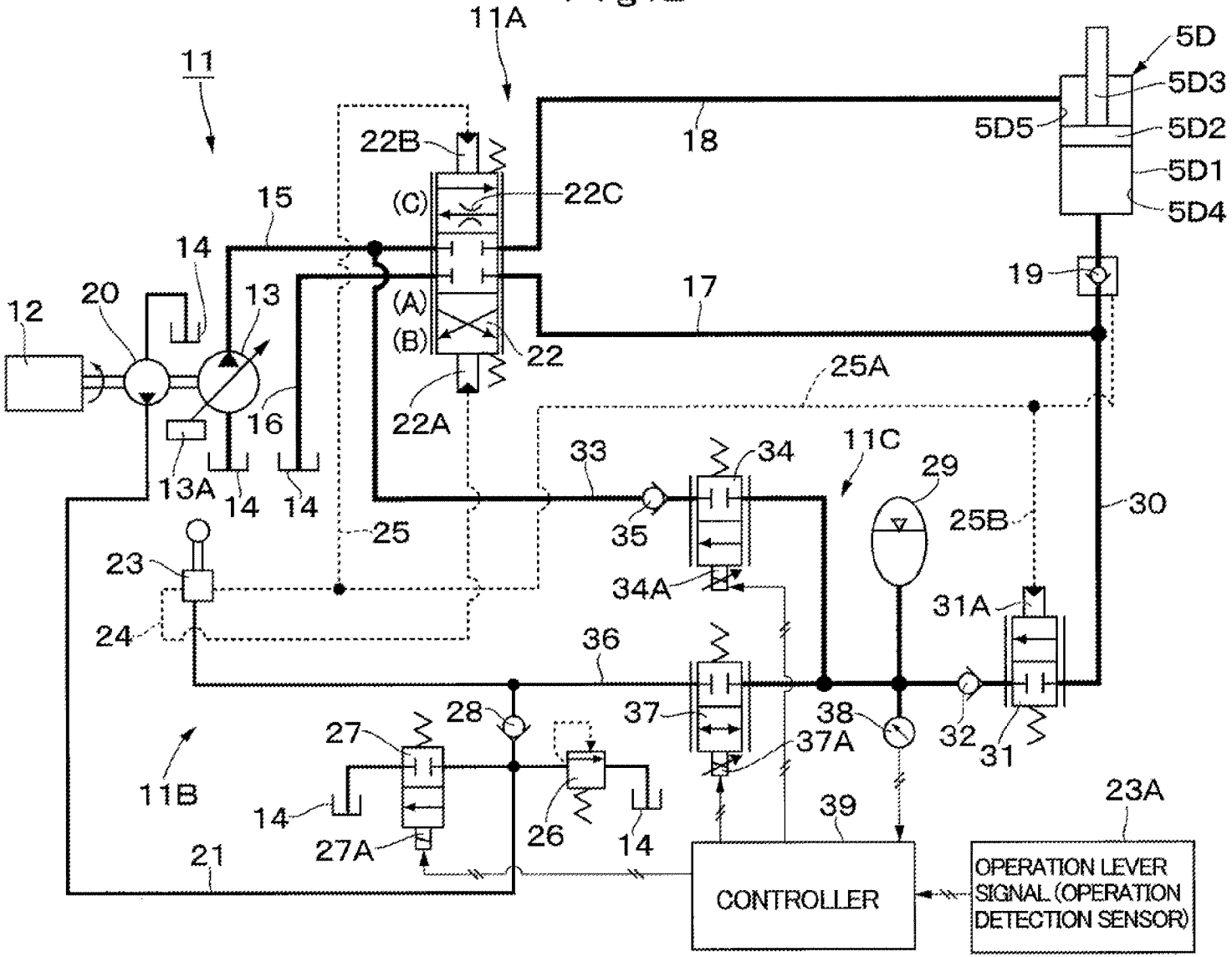
FIG. 2 is a hydraulic circuit diagram of the hydraulic excavator according to a first embodiment.
Figure 3:
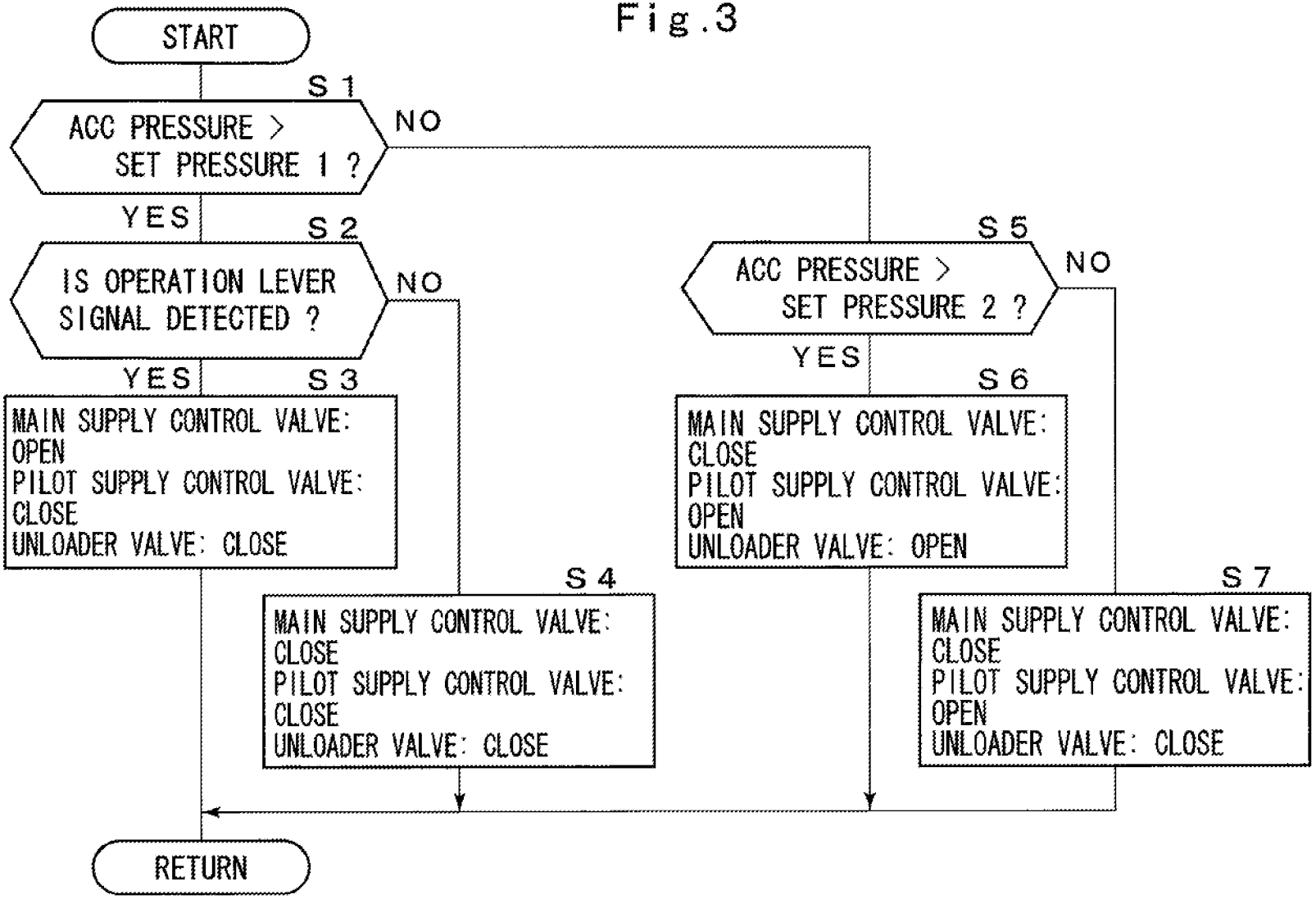
FIG. 3 is a flow chart showing the processing in a controller shown in FIG. 2.

FIG. 1 to FIG. 3 shows a first embodiment. In FIG. 1, a hydraulic excavator 1, which is a representative example of a construction machine, is configured to include an automotive lower traveling structure 2 of a crawler type, a revolving device 3 mounted on the lower traveling structure 2, an upper revolving structure 4 mounted on the lower traveling structure 2 to be capable of revolving thereon via the revolving device 3, and a working mechanism 5 with a multi-joint structure which is provided in the front side of the upper revolving structure 4 to perform an excavating work and the like. In this case, the lower traveling structure 2 and the upper revolving structure 4 form part of a vehicle body of the hydraulic excavator 1.

The lower traveling structure 2 is configured to include, for example, crawler belts 2A and left and right traveling hydraulic motors (not shown) that drive the rotation of the crawler belts 2A to cause the hydraulic excavator 1 to travel. The lower traveling structure 2 travels together with the upper revolving structure 4 and the working mechanism 5 by rotation of the travel hydraulic motors which are hydraulic motors, based on a delivery of pressurized oil from a main hydraulic pump 13 to be described later (see FIG. 2).

The working mechanism 5, which is also called a working machine or a front, is configured to include, for example, a boom 5A, an arm 5B and a bucket 5C as a working tool, as well as a boom cylinder 5D, an arm cylinder 5E and a bucket cylinder (a working tool cylinder) 5F which serve as hydraulic actuators (liquid pressure actuators) driving the boom 5A, the arm 5B and the bucket 5C. The cylinders 5D, 5E, 5F which are hydraulic cylinders extend or contract based on a delivery of pressurized oil from the main hydraulic pump 13, thereby causing the working mechanism 5 to tilt up or down (swing) to be described later (see FIG. 2). It should be noted that a hydraulic circuit associated with the boom 5A is mainly shown in the later-described hydraulic circuit diagram of FIG. 2 for the sake of avoiding the figure from being complicated. That is, the hydraulic circuit diagram associated with the arm cylinder 5E, the bucket cylinder 5F, the above-described left and right traveling hydraulic motors and a later-described revolving hydraulic motor is omitted in the hydraulic circuit diagram of FIG. 2.

The upper revolving structure 4 is mounted on the lower traveling structure 2 via the revolving device 3 which is configured to include a revolving bearing, a revolving hydraulic motor, a reduction mechanism and the like. The upper revolving structure 4 revolves together with the working mechanism 5 on the lower traveling structure 2 by rotation of the revolving hydraulic motor which is a hydraulic motor, based on a delivery of the pressurized oil from the later-described main hydraulic pump 13 (see FIG. 2). The upper revolving structure 4 is configured to include a revolving frame 6 which is a support structure (a base frame) of the upper revolving structure 4, a cab 7 mounted on the revolving frame 6, a counterweight 8 and the like. In this case, the revolving frame 6 is provided with a later-described engine 12, hydraulic pumps 13, 20, a hydraulic oil tank 14, a control valve device (only a boom directional control valve 22 is shown in FIG. 2), and the like, which are mounted thereon.

The revolving frame 6 is mounted on the lower traveling structure 2 via the revolving device 3. The cab 7 having the interior serving as a driver's room is provided on a front part left side of the revolving frame 6. An operator seat (not shown) on which an operator sits is mounted within the cab 7. An operating device for operating the hydraulic excavator 1 (only a boom lever operating device 23 is shown in FIG. 2) is placed around the operator seat. The operating device is configured to include, for example, left and right traveling lever pedal operating devices which are placed in front of the operator seat, and left and right working lever operating devices which are placed respectively on the left and right sides of the operator seat.

The left and right traveling lever pedal operating devices are operated by the operator at the time of causing the lower traveling structure 2 to travel. The left and right working lever operating devices are operated by the operator at the time of causing the working mechanism 5 to operate and at the time of causing the upper revolving structure 4 to revolve. It should be noted that only the boom lever operating device 23 for the operation (swinging) of the boom 5A of the working mechanism 5, of the various operating devices (the traveling operating devices and the working operating devices) is shown in the hydraulic circuit diagram of FIG. 2 to be described later. That is, in the hydraulic circuit diagram of FIG. 2, the left and right traveling lever pedal operating devices, the revolving lever operating device, the arm lever operating device, the bucket lever operating device and the like are omitted. An operation of the boom lever operating device 23 corresponds to an operation in the front-rear direction of the working lever operating device on the right side, for example.

The operating device outputs a pilot signal (a pilot pressure) in response to the operator's operation (a lever operation or a pedal operation) to a control valve device configured of a plurality of directional control valves (only the boom directional control valve 22 is shown in FIG. 2). Thus, the operator can operate (drive) the traveling hydraulic motor, the cylinders 5D, 5E, 5F of the working mechanism 5 and the revolving hydraulic motor of the revolving device 3. It should be noted that only the boom directional control valve 22 of the plurality of directional control valves included in the control valve device is shown in the hydraulic circuit diagram of FIG. 2 to be described later. That is, a left traveling directional control valve, a right traveling directional control valve, a revolving directional control valve, an arm directional control valve, a bucket directional control valve and the like are omitted in the hydraulic circuit diagram of FIG. 2.

A controller 39 (see FIG. 2) to be described later is provided within the cab 7 and located on the underside at the rear side of the operator seat. On the other hand, the counterweight 8 is provided on the rear end side of the revolving frame 6 to act as a weight balance to the working mechanism 5.

Next, an explanation will be made of a hydraulic drive device for driving the hydraulic excavator 1 with reference to FIG. 2 in addition to FIG. 1.

As shown in FIG. 2, the hydraulic excavator 1 is provided with a hydraulic circuit 11 to cause the hydraulic excavator 1 to operate (drive) based on the pressurized oil delivered from the hydraulic pump 13. The hydraulic circuit 11 is configured to include a main hydraulic circuit 11A including a hydraulic actuator (for example, the boom cylinder 5D), a pilot hydraulic circuit 11B for operating a hydraulic actuator (for example, the boom cylinder 5D), and a recovery hydraulic circuit 11C including the later-described accumulator 29.

That is, the hydraulic circuit 11 is configured to include the hydraulic actuator (for example, the boom cylinder 5D), the engine 12, the main hydraulic pump 13, the hydraulic oil tank 14 as a tank, a pilot hydraulic pump 20, the control valve device (for example, the boom directional control valve 22), and the operating device (for example, the boom lever operating device 23). In addition to this, the hydraulic circuit 11 is configured to include the accumulator 29, a recovery control valve 31 serving as a recovery device and a first control valve, a main supply control valve 34 serving as a main circuit supply device and a second control valve, a pilot supply control valve 37 serving as a pilot circuit supply device and a third control valve, an accumulator-side pressure sensor 38 serving as a first pressure detector, and a controller 39 serving as a control device.

The main hydraulic circuit 11A of the hydraulic circuit 11 is provided with, in addition to the hydraulic actuator (for example, the boom cylinder 5D), the engine 12, the main hydraulic pump 13, the hydraulic oil tank 14, the control valve device (for example, the boom directional control valve 22), and a pilot check valve 19 (a first pilot check valve). The main hydraulic circuit 11A is also provided with a main delivery line 15, a return line 16, a bottom side line 17 and a rod side line 18.

On the other hand, the pilot hydraulic circuit 11B of the hydraulic circuit 11 is provided with the engine 12, the pilot hydraulic pump 20, the hydraulic oil tank 14, the operating device (for example, the boom lever operating device 23), a pilot delivery line 21, a relief valve 26, an extending-side pilot line 24 serving as an one-side pilot line, and a contracting-side pilot line 25 serving as an other-side pilot line. The pilot hydraulic circuit 11B is also provided with an unloader valve 27 serving as a pilot flow reducing device, and a check valve 28 serving as a non-return valve.

Further, the recovery hydraulic circuit 11C of the hydraulic circuit 11 forms a pressurized-oil energy recovery device, and is provided with, in addition to the accumulator 29, a recovery control valve 31, a main supply control valve 34, a pilot supply control valve 37, an accumulator-side pressure sensor 38, and the controller 39. The recovery hydraulic circuit 11C is also provided with a recovery line 30, a recovery check valve 32, a main regeneration line 33 and a pilot regeneration line 36.

It should be noted that the hydraulic circuit 11 shown in FIG. 2 mainly shows a boom hydraulic circuit (that is, a boom hydraulic drive device) for driving (extending or contracting) the boom cylinder 5D. In other words, the hydraulic circuit 11 shown in FIG. 2 omits in illustration a traveling hydraulic circuit (that is, a traveling hydraulic drive device) for causing the lower traveling structure 2 to travel, an arm hydraulic circuit (that is, an arm hydraulic drive device) for driving (extending or contracting) the arm 5B, a bucket hydraulic circuit (that is, a bucket hydraulic drive device) for driving (extending or contracting) the bucket 5C, and a revolving hydraulic circuit (that is, a revolving hydraulic drive device) for driving the revolving device 3 (revolving the upper revolving structure 4 relative to the lower traveling structure 2).

The engine 12 is mounted on the revolving frame 6. The engine 12 is configured of, for example, an internal combustion engine such as a diesel engine or the like. The main hydraulic pump 13 and the pilot hydraulic pump 20 are mounted to the output side of the engine 12. The hydraulic pumps 13, 20 are driven and rotated by the engine 12. It should be noted that a drive source (power source) for driving the hydraulic pumps 13, 20 may be configured of the engine 12 alone which is an internal combustion engine, or alternatively, may be configured of, for example, a combination of the engine and an electric motor or the electric motor alone.

The main hydraulic pump 13 is connected mechanically to the engine 12 (that is, in such a manner that power can be transferred). The main hydraulic pump 13 delivers pressurized oil to the main hydraulic circuit 11A including the hydraulic actuator (the boom cylinder 5D). The main hydraulic pump 13 is configured of, for example, a variable displacement hydraulic pump, more specifically, a variable displacement swash-plate type, variable displacement bent-axis type or variable displacement radial-piston type hydraulic pump. It should be noted that FIG. 2 shows the main hydraulic pump 13 serving as a single hydraulic pump, but the main hydraulic pump 13 may be configured of two or more hydraulic pumps.

The main hydraulic pump 13 is connected to the hydraulic actuator via the control valve device. For example, the main hydraulic pump 13 is connected to the boom cylinder 5D serving as the hydraulic actuator via the boom directional control valve 22, and delivers pressurized oil to the boom cylinder 5D. It should be noted that, although omitted in illustration, the main hydraulic pump 13 also delivers pressurized oil, for example, to the traveling hydraulic motor, the revolving hydraulic motor, the arm cylinder 5E and the bucket cylinder 5F in addition to the boom cylinder 5D.

The main hydraulic pump 13 delivers the hydraulic oil reserved in the hydraulic oil tank 14 to the main delivery line 15, as pressurized oil. The pressurized oil delivered to the main delivery line 15 is supplied through the boom directional control valve 22 to the boom cylinder 5D (a bottom-side oil chamber 5D4 or a rod-side oil chamber 5D5 of the boom cylinder 5D). The pressurized oil in the boom cylinder 5D (the rod-side oil chamber 5D5 or the bottom-side oil chamber 5D4 thereof) returns through the boom directional control valve 22 and the return line 16 to the hydraulic oil tank 14. In this way, the main hydraulic pump 13 forms a main hydraulic source together with the hydraulic oil tank 14 reserving the hydraulic oil.

As shown in FIG. 2, the boom cylinder 5D is configured to include a tube 5D1, a piston 5D2, and a rod 5D3. The piston 5D2 is slidably fitted into the tube 5D1, and the tube 5D1 is defined (separated) into the bottom-side oil chamber 5D4 and the rod-side oil chamber 5D5. The rod 5D3 has a base end secured to the piston 5D2 and a front end extending out of the tube 5D1. The bottom side line 17 is served for connection between the boom directional control valve 22 and the bottom-side oil chamber 5D4. The rod side line 18 is served for connection between the boom directional control valve 22 and the rod-side oil chamber 5D5.

In this case, the later-described recovery line 30 is connected to the course of the bottom side line 17. In addition, the pilot check valve 19 is provided on the bottom side line 17 to be located between the bottom-side oil chamber 5D4 of the boom cylinder 5D and a connecting part (a branch part) between the bottom side line 17 and the recovery line 30. A pilot pressure (a secondary pressure) in response to an operation of the boom lever operating device 23 is supplied to the pilot check valve 19. The pilot check valve 19 allows the flow of pressurized oil from the boom directional control valve 22-side (and the recovery line 30-side) toward the bottom-side oil chamber 5D4, and blocks the flow of pressurized oil from the bottom-side oil chamber 5D4 toward the boom directional control valve 22-side (and the recovery line 30-side). The pilot check valve 19 is opened when the pilot pressure is supplied to the pilot check valve 19 (that is, when the boom lever operating device 23 is operated in a direction of contracting the boom cylinder 5D). That is, in this case, the pilot check valve 19 allows the flow of pressurized oil from the bottom-side oil chamber 5D4 toward the boom directional control valve 22-side and the recovery line 30-side.

As similar to the main hydraulic pump 13, the pilot hydraulic pump 20 is mechanically connected to the engine 12. The pilot hydraulic pump 20 delivers pressurized oil to the pilot hydraulic circuit 11B for operating the hydraulic actuator (for example, the boom cylinder 5D). The pilot hydraulic pump 20 is configured of, for example, a fixed displacement gear pump or a swash-plate hydraulic pump. The pilot hydraulic pump 20 delivers the hydraulic oil reserved in the hydraulic oil tank 14 to the pilot delivery line 21, as the pressurized oil. That is, the pilot hydraulic pump 20 forms a pilot hydraulic source together with the hydraulic oil tank 14.

The pilot hydraulic pump 20 is connected to the operating device (the boom lever operating device 23). The pilot hydraulic pump 20 delivers pressurized oil (a primary pressure) to the operating device (the boom lever operating device 23). In this case, the pressurized oil of the pilot hydraulic pump 20 is delivered through the operating device (the boom lever operating device 23) to the control valve device (hydraulic pilot parts 22A, 22B of the boom directional control valve 22), the pilot check valve 19 and the later-described recovery control valve 31.

The control valve device is a control valve group configured of a plurality of directional control valves including the boom directional control valve 22. The control valve device distributes the pressurized oil delivered from the main hydraulic pump 13 to the boom cylinder 5D, the arm cylinder 5E, the bucket cylinder 5F, the traveling hydraulic motor and the revolving hydraulic motor in response to operations of various operating devices including the boom lever operating device 23.

It should be noted that the following description will be given using the boom directional control valve 22 (hereinafter, referred to simply as the "directional control valve 22" as well) as a representative example of the control valve device. In addition, as to the operating device for performing a switching operation of the control valve device, the following description will be also given using the boom lever operating device 23 (hereinafter, referred to as simply as the "lever operating device 23" as well) for performing a switching operation of the boom directional control valve 22 as a representative example. In addition, also as to the hydraulic actuator operated (extended or contracted) by an operation of the operating device, the following description will be given using the boom cylinder 5D (hereinafter, referred to simply as the "hydraulic cylinder 5D" as well) as a representative example.

The directional control valve 22 controls the direction of pressurized oil delivered from the main hydraulic pump 13 to the hydraulic cylinder 5D in response to a switching signal (a pilot pressure) caused by the operation of the lever operating device 23 located within the cab 7. Therefore, the hydraulic cylinder 5D is driven (extended or contracted) by the pressurized oil (the hydraulic oil) supplied (delivered) from the main hydraulic pump 13. The directional control valve 22 is configured of a pilot-operated directional control valve, for example, a hydraulic pilot directional control valve of a 4-port and a 3-position (or a 6-port and a 3-position).

The directional control valve 22 switches delivery and suction of the pressurized oil to and from the hydraulic cylinder 5D, between the main hydraulic pump 13 and the hydraulic cylinder 5D to extend or contract the hydraulic cylinder 5D. A switching signal (a pilot pressure) based on the operation of the lever operating device 23 is supplied to the hydraulic pilot parts 22A, 22B of the directional control valve 22. Thus, the directional control valve 22 is switched from a neutral position (A) to a switch position (B) or (C).

The lever operating device 23 is located within the cab 7 of the upper revolving structure 4. The lever operating device 23 is configured of a lever style, pressure reducing valve type pilot valve, for example. Pressurized oil (a primary pressure) is delivered from the pilot hydraulic pump 20 through the pilot delivery line 21 to the lever operating device 23. The lever operating device 23 outputs a pilot pressure (a secondary pressure) in response to the lever operation of the operator, to the directional control valve 22 through the extending-side pilot line 24 or the contracting-side pilot line 25.

That is, the lever operating device 23 is operated by the operator, and thereby, supplies (outputs) a pilot pressure in proportion to the operation amount to the hydraulic pilot part 22A or 22B of the directional control valve 22. For example, when the lever operating device 23 is operated in a direction of extending the boom cylinder 5D (that is, the raising operation is performed to raise the boom 5A), a pilot pressure Pu produced by the operation is supplied to the hydraulic pilot part 22A of the directional control valve 22 through the extending-side pilot line 24. This causes the directional control valve 22 to switch from the neutral position (A) to the switch position (B). Therefore, the pressurized oil from the main hydraulic pump 13 is delivered to the bottom-side oil chamber 5D4 of the hydraulic cylinder 5D via the bottom side line 17. The pressurized oil in the rod-side oil chamber 5D5 of the hydraulic cylinder 5D is returned to the hydraulic oil tank 14 via the rod side line 18 and the return line 16.

On the contrary, for example, when the lever operating device 23 is operated in a direction of contracting the boom cylinder 5D (that is, the lowering operation is performed to lower the boom 5A), a pilot pressure Pd produced by the operation is supplied to the hydraulic pilot part 22B of the directional control valve 22 through the contracting-side pilot line 25. This causes the directional control valve 22 to switch from the neutral position (A) to the switch position (C). Therefore, the pressurized oil from the main hydraulic pump 13 is delivered to the rod-side oil chamber 5D5 of the hydraulic cylinder 5D via the rod side line 18.

At this time, the pilot pressure Pd is also delivered to the pilot check valve 19 via a branch line 25A which branches off from the course of the contracting-side pilot line 25. Therefore, the pilot check valve 19 is pressurized by the pilot pressure Pd, so that the pilot check valve 19 is opened. Thus, the pressurized oil in the bottom-side oil chamber 5D4 of the hydraulic cylinder 5D flows through the bottom side line 17. That is, the pilot check valve 19 is provided to prevent an accidental outflow of the pressurized oil from the bottom-side oil chamber 5D4 of the hydraulic cylinder 5D (the boom falling). Because of this, the circuit is blocked under normal conditions and the circuit is opened by the pilot pressure Pd.

The pilot pressure Pd is also delivered to the later-described recovery control valve 31 via another branch line 25B which branches off from the course of the branch line 25A. When the pilot pressure Pd is delivered to the recovery control valve 31, the recovery control valve 31 is switched to an open position where the hydraulic cylinder 5D and the accumulator 29 are connected. Thus, the pressurized oil in the bottom-side oil chamber 5D4 of the hydraulic cylinder 5D is supplied to the accumulator 29. That is, the pressurized oil in the bottom-side oil chamber 5D4 of the hydraulic cylinder 5D is recovered into the accumulator 29. At this time, the pressurized oil that flows from the bottom-side oil chamber 5D4 of the hydraulic cylinder 5D through the bottom side line 17 toward the directional control valve 22, that is, the pressurized oil that returns to the hydraulic oil tank 14, is throttled (limited) by a throttle 22C in the switch position (C) of the directional control valve 22.

It should be noted that the lever operating device 23 is provided with an operation detection sensor 23A as an operation detector that detects the operation of the lever operating device 23 (presence or absence of a lever operation or a lever operating amount). The operation detection sensor 23A is connected to the controller 39. The operation detection sensor 23A outputs a signal corresponding to the presence or absence of the lever operation or the lever operating amount to the controller 39, as an operation lever signal. The operation detection sensor 23A may be configured of, for example, a displacement sensor detecting a displacement of the lever or a pressure sensor detecting a pilot pressure Pu, Pd outputted from the lever operating device 23 to the directional control valve 22. The operation detection sensor 23A is mounted in not only the boom lever operating device 23 shown in FIG. 2, but also the operating devices omitted in illustration.

The relief valve 26 is provided in the course of the pilot delivery line 21. The relief valve 26 is located upstream of the later-described check valve 28 and between the pilot delivery line 21 and the hydraulic oil tank 14. The relief valve 26 is opened when the pressure in the pilot delivery line 21 exceeds a predetermined pressure (a set pressure) to relieve an excessive pressure toward the hydraulic oil tank 14.

In addition, the unloader valve 27 and the check valve 28 are provided in the course of the pilot delivery line 21. The later-described pilot regeneration line 36 is located between the check valve 28 and the lever operating device 23 and is connected to the course of the pilot delivery line 21.

The unloader valve 27 is located between the pilot hydraulic pump 20 and the pilot hydraulic circuit 11B (that is, on the delivery side of the pilot hydraulic pump 20 and upstream of the check valve 28). The unloader valve 27 discharges the pressurized oil delivered from the pilot hydraulic pump 20, into the hydraulic oil tank 14. The unloader valve 27 is configured of, for example, an electromagnetic pilot switching valve (an electromagnetic solenoid switching valve or an electromagnetic control valve) of a 2-port and a 2-position. An electromagnetic pilot part 27A of the unloader valve 27 is connected to the controller 39.

The unloader valve 27 is regularly in the closed position, for example. The unloader valve 27 switches from the closed position to the open position in response to a signal (an instruction) from the controller 39. When the unloader valve 27 is in the open position, the unloader valve 27 connects the pilot delivery line 21 and the hydraulic oil tank 14. That is, in response to an instruction (supply of power) from the controller 39, the unloader valve 27 discharges the pressurized oil delivered from the pilot hydraulic pump 20 into the hydraulic oil tank 14. Thus, the unloader valve 27 forms a pilot flow reducing device capable of reducing the rate of flow from the pilot hydraulic pump 20 to the pilot hydraulic circuit 11B (more specifically, to the lever operating device 23-side).

The check valve 28 is provided between the unloader valve 27 and the pilot hydraulic circuit 11B (that is, downstream of the unloader valve 27 and upstream of the connecting section between the pilot regeneration line 36 and the pilot delivery line 21). The check valve 28 is a non-return valve to block the pressurized oil of the pilot hydraulic circuit 11B-side (more specifically, the lever operating device 23-side) from flowing into the unloader valve 27-side. The check valve 28 allows the flow of pressurized oil from the pilot hydraulic pump 20-side toward the lever operating device 23-side and the pilot regeneration line 36-side, and blocks the flow of pressurized oil from the lever operating device 23-side and the pilot regeneration line 36-side toward the unloader valve 27-side and the pilot hydraulic pump 20-side.

The pilot regeneration line 36 is connected to a portion of the pilot delivery line 21 downstream of the check valve 28. Therefore, as described later, the pressurized oil in the accumulator 29 flows (is supplied) from the pilot supply control valve 37-side into between the check valve 28 and the lever operating device 23 (a portion of the pilot delivery line 21 downstream of the check valve 28). Therefore, for example, when the pressurized oil from the pilot hydraulic pump 20 is being discharged into the hydraulic oil tank 14 by the unloader valve 27, the pressurized oil from the accumulator 29-side can be blocked from flowing to the unloader valve 27-side (the hydraulic oil tank 14-side).

The accumulator 29 is an accumulator that accumulates the pressurized oil discharged from the hydraulic cylinder 5D. That is, when the hydraulic cylinder 5D is contracted, the pressurized oil discharged from the bottom-side oil chamber 5D4 of the hydraulic cylinder 5D flows into the accumulator 29 through the recovery line 30, the recovery control valve 31 and the recovery check valve 32 from the bottom side line 17-side. In this way, the accumulator 29 accumulates the pressurized oil. In addition, as described later, the pressurized oil delivered from the pilot hydraulic pump 20 flows into the accumulator 29 through the pilot regeneration line 36 and the pilot supply control valve 37 from the pilot delivery line 21-side as needed. The pressurized oil accumulated in the accumulator 29 is supplied to the hydraulic cylinder 5D or the lever operating device 23 in response to the switch position of the main supply control valve 34 and the switch position of the pilot supply control valve 37.

The recovery line 30 is connected at one end to the bottom side line 17 and at the other end to the accumulator 29. In the course of the recovery line 30, the recovery control valve 31 and the recovery check valve 32 are provided in order from one end (from the bottom side line 17-side). The recovery control valve 31 forms a recovery device to recover the pressurized oil discharged from the hydraulic cylinder 5D, to the accumulator 29. That is, the recovery control valve 31 is a first control valve for switching connection and block between the bottom-side oil chamber 5D4 of the hydraulic cylinder 5D and the accumulator 29. The recovery control valve 31 is configured of, for example, a hydraulic pilot switching valve of a 2-port and a 2-position. A pilot pressure is supplied to a hydraulic pilot part 31A of the recovery control valve 31 from the lever operating device 23. The recovery control valve 31 is, for example, regularly in the closed position, and switches from the closed position to the open position when the pilot pressure is supplied to the hydraulic pilot part 31A.

That is, in a case where the lever operating device 23 is operated in the direction of contracting the hydraulic cylinder 5D, a pilot pressure in response to the operation of the lever operating device 23 is supplied to the hydraulic pilot part 31A of the recovery control valve 31 through the branch lines 25A, 25B of the contracting-side pilot line 25. This causes the recovery control valve 31 to switch to the open position to allow fluid communication (connection) between the hydraulic cylinder 5D (the bottom-side oil chamber 5D4 thereof) and the accumulator 29. At this time, the pressurized oil discharged from the bottom-side oil chamber 5D4 of the hydraulic cylinder 5D is accumulated in the accumulator 29. On the other hand, the recovery control valve 31 is in the closed position to block fluid communication between the hydraulic cylinder 5D (the bottom-side oil chamber 5D4 thereof) and the accumulator 29 while the lever operating device 23 is not operated in the direction of contracting the hydraulic cylinder 5D.

The recovery check valve 32 is located between the recovery control valve 31 and the accumulator 29 in the recovery line 30. The recovery check valve 32 allows the pressurized oil to flow from the recovery control valve 31-side toward the accumulator 29-side, and blocks the pressurized oil from flowing from the accumulator 29-side toward the recovery control valve 31-side. That is, the recovery check valve 32 prevents a back-flow of the pressurized oil from the accumulator 29 toward the hydraulic cylinder 5D (the bottom-side oil chamber 5D4 thereof).

The main regeneration line 33 is provided for connection between the accumulator 29 and the main delivery line 15. Specifically, the main regeneration line 33 is connected at one end to the accumulator 29 and at the other end to the main delivery line 15 (that is, between the main hydraulic pump 13 and the directional control valve 22). In the course of the main regeneration line 33, the main supply control valve 34 and the main check valve 35 are provided in order from one end (from the accumulator 29-side). The main supply control valve 34 forms a main circuit supply device to supply the pressurized oil accumulated in the accumulator 29, to the main hydraulic circuit 11A (more specifically, to the main delivery line 15). That is, the main supply control valve 34 is a second control valve for switching connection and block between the main hydraulic circuit 11A (the main delivery line 15) and the accumulator 29.

The main supply control valve 34 is configured of, for example, an electromagnetic pilot switching valve (an electromagnetic solenoid switching valve or an electromagnetic control valve) of a 2-port and a 2-position. An electromagnetic pilot part 34A of the main supply control valve 34 is connected to the controller 39. The main supply control valve 34 is, for example, regularly in the closed position, and switches from the closed position to the open position in response to a signal (an instruction or supply of power) from the controller 39. When the main supply control valve 34 is in the open position, the accumulator 29 and the main delivery line 15 are connected to each other, so that the pressurized oil in the accumulator 29 is supplied to the hydraulic cylinder 5D through the directional control valve 22.

The main check valve 35 is provided between the main supply control valve 34 and the main delivery line 15 (the main hydraulic circuit 11A) in the main regeneration line 33. The main check valve 35 allows the pressurized oil to flow from the accumulator 29-side toward the main delivery line 15-side, and blocks the pressurized oil from flowing from the main delivery line 15-side toward the accumulator 29-side. That is, the main check valve 35 prevents a back-flow of the pressurized oil from the main delivery line 15 toward the accumulator 29.

The pilot regeneration line 36 is provided for connection between the accumulator 29 and the pilot delivery line 21. That is, the pilot regeneration line 36 is connected at one end to the accumulator 29 and at the other end to the pilot delivery line 21 (that is, between the check valve 28 and the lever operating device 23). The pilot supply control valve 37 is provided in the course of the pilot regeneration line 36. The pilot supply control valve 37 forms a pilot circuit supply device to supply the pressurized oil accumulated in the accumulator 29, to the pilot hydraulic circuit 11B (more specifically, to the pilot delivery line 21). That is, the pilot supply control valve 37 is a third control valve for switching connection and block between the accumulator 29 and the pilot hydraulic circuit 11B (the pilot delivery line 21).

The pilot supply control valve 37 is configured of, for example, an electromagnetic pilot switching valve (an electromagnetic solenoid switching valve or an electromagnetic control valve) of a 2-port and a 2-position. An electromagnetic pilot part 37A of the pilot supply control valve 37 is connected to the controller 39. The pilot supply control valve 37 is, for example, regularly in the closed position, and switches from the closed position to the open position in response to a signal (an instruction or supply of power) from the controller 39. When the pilot supply control valve 37 is in the open position, the accumulator 29 and the pilot delivery line 21 are connected to each other, so that the pressurized oil in the accumulator 29 can be supplied to the lever operating device 23. In addition, when the pilot supply control valve 37 is in the open position, in a case where the pressure in the accumulator 29 is lower than the pressure in the pilot delivery line 21, the pressurized oil in the pilot delivery line 21 can be supplied to the accumulator 29.

The accumulator-side pressure sensor 38 is provided to the accumulator 29. More specifically, the accumulator-side pressure sensor 38 is provided between the recovery check valve 32 and the accumulator 29 in the recovery line 30 (in other words, between the accumulator 29 and the main supply control valve 34 or the pilot supply control valve 37). The accumulator-side pressure sensor 38 is a first pressure detector that detects a pressure in the accumulator 29 and outputs the detected pressure signal to the controller 39. For this purpose, the accumulator-side pressure sensor 38 is connected to the controller 39, and outputs the detected pressure in the accumulator 29 (a signal corresponding to the detected pressure) to the controller 39.

The controller 39 has an input side connected to the accumulator-side pressure sensor 38 and the operation detection sensor 23A. The controller 39 has an output side connected to the main supply control valve 34, the pilot supply control valve 37 and the unloader valve 27. The controller 39 is a control device that determines which one of the main hydraulic circuit 11A (the main delivery line 15) and the pilot hydraulic circuit 11B (the pilot delivery line 21) the pressurized oil accumulated in the accumulator 29 should be supplied to, and also controls the main supply control valve 34 and the pilot supply control valve 37 based on the determination. In this case, the controller 39 controls the main supply control valve 34 and the pilot supply control valve 37 in accordance with the pressure in the accumulator 29 detected by the accumulator-side pressure sensor 38. Additionally, the controller 39 also controls the unloader valve 27 in accordance with the pressure in the accumulator 29 detected by the accumulator-side pressure sensor 38.

Therefore, the controller 39 is configured to include a microcomputer, a drive circuit, a power circuit and the like, for example. In this case, the controller 39 has a computing circuit (CPU) and a memory including a flash memory, a ROM, a RAM, an EEPROM and the like. The memory has programs (for example, a processing program for executing the processing flow shown in FIG. 3 to be described later) stored therein for use in control processing for the main supply control valve 34, the pilot supply control valve 37 and the unloader valve 27.

In a case where the pressure in the accumulator 29 exceeds a preset first set pressure (a set pressure 1), the controller 39 controls the main supply control valve 34 such that the pressurized oil in the accumulator 29 is supplied to the main hydraulic circuit 11A (the main delivery line 15). That is, when the pressure in the accumulator 29 detected by the accumulator-side pressure sensor 38 (an ACC pressure) exceeds the set pressure 1, the controller 39 switches the main supply control valve 34 to the open position. Thereby, the pressurized oil in the accumulator 29 is supplied to the main delivery line 15.

In addition, in a case where the pressure in the accumulator 29 is lower than the preset first set pressure (the set pressure 1), the controller 39 controls the pilot supply control valve 37 such that the pressurized oil in the accumulator 29 is supplied to the pilot hydraulic circuit 11B (the pilot delivery line 21). That is, when the pressure in the accumulator 29 detected by the accumulator-side pressure sensor 38 is lower than the set pressure 1, the controller 39 switches the pilot supply control valve 37 to the open position. Thereby, the pressurized oil in the accumulator 29 is supplied to the pilot delivery line 21 (alternatively, the pressurized oil in the pilot delivery line 21 is supplied to the accumulator 29 as needed).

At this time, that is, when the pressurized oil in the accumulator 29 is being supplied to the pilot delivery line 21, the controller 39 switches the unloader valve 27 to the open position. That is, the controller 39 controls the unloader valve 27 (to the open position) such that, when the pressure in the accumulator 29 is lower than the preset first set pressure (the set pressure 1) and also exceeds a second set pressure (a set pressure 2) which is set to be lower than the first set pressure (the set pressure 1), the flow rate from the pilot hydraulic pump 20 to the pilot hydraulic circuit 11B (to the pilot delivery line 21 upstream of the check valve 28) is reduced.

It should be noted that the set pressure 1 which is the first set pressure is preset so as to serve as a determination value that can be used to make an appropriate determination whether the pressurized oil in the accumulator 29 should be supplied to the main hydraulic circuit 11A (the main delivery line 15) or the pilot hydraulic circuit 11B (the pilot delivery line 21). That is, the set pressure 1 is in advance found through experiments, calculations, simulations and the like such that the pressurized oil in the accumulator 29 can be efficiently utilized for the main hydraulic circuit 11A and the pilot hydraulic circuit 11B. For example, the set pressure 1 may be set as a pressure slightly higher (for example, higher by approximately 0.5 to 1 MPa) than the pressure (the primary pressure) in the pilot hydraulic circuit 11B (the pilot delivery line 21).

In addition, the set pressure 2 which is the second set pressure is preset so as to serve as a determination value that can be used for the appropriate switching of the unloader valve 27 from the open position to the closed position. That is, the set pressure 2 is in advance found through experiments, calculations, simulations and the like such that the unloader valve 27 is switched to the open position when an appropriate pressurized oil (a primary pressure) can be supplied from the accumulator 29 to the lever operating device 23, and also the output of the pilot hydraulic pump 20 can be appropriately reduced. For example, the set pressure 2 may be set as a pressure slightly lower (for example, lower by approximately 0.5 MPa) than the pressure (the primary pressure) in the pilot hydraulic circuit 11B (the pilot delivery line 21). Incidentally, the control processing in FIG. 3 to be performed in the controller 39 will be described later in detail.

The hydraulic excavator 1 according to the first embodiment has the configuration as described above, and an operation thereof will be described below.

When the operator who gets on the cab 7 starts the engine 12, the hydraulic pumps 13, 20 are driven by the engine 12. Thus, the pressurized oil delivered from the hydraulic pumps 13, 20 are delivered toward the traveling hydraulic motor, the revolving hydraulic motor, and the boom cylinder 5D, the arm cylinder 5E and the bucket cylinder 5F of the working mechanism 5 in response to the pedal operation and the lever operation on the traveling operating device and the working operating device (the lever operating device 23) all of which are provided within the cab 7. Thereby, the hydraulic excavator 1 can perform the traveling movement by the lower traveling structure 2, the revolving movement of the upper revolving structure 4, the excavating work by the working mechanism 5, and the like.

In this case, for example, when the lever operating device 23 is operated in the direction of extending the hydraulic cylinder 5D (that is, when the raising operation is performed to raise the boom 5A), a pilot pressure is supplied from the lever operating device 23 to the hydraulic pilot part 22A of the directional control valve 22. This causes the directional control valve 22 to switch from the neutral position (A) to the switch position (B). In this case, the pressurized oil from the main hydraulic pump 13 is delivered through the bottom side line 17 and the pilot check valve 19 to the bottom-side oil chamber 5D4 of the hydraulic cylinder 5D, so that the hydraulic cylinder 5D is extended. In step with this, the pressurized oil discharged from the rod-side oil chamber 5D5 of the hydraulic cylinder 5D returns through the rod side line 18 and the directional control valve 22 to the hydraulic oil tank 14. At this time, since the recovery control valve 31 is in the closed position, no pressurized oil is supplied from the main hydraulic circuit 11A-side to the accumulator 29.

On the contrary, when the lever operating device 23 is operated in the direction of contracting the hydraulic cylinder 5D (that is, when the lowering operation is performed to lower the boom 5A), a pilot pressure is supplied from the lever operating device 23 to the hydraulic pilot part 22B of the directional control valve 22. This causes the directional control valve 22 to switch from the neutral position (A) to the switch position (C). In this case, the pressurized oil from the main hydraulic pump 13 is delivered through the rod side line 18 to the rod-side oil chamber 5D5 of the hydraulic cylinder 5D. At this time, the pilot pressure from the lever operating device 23 is also supplied to the pilot check valve 19 and the recovery control valve 31, so that the pilot check valve 19 opens the circuit and also the recovery control valve 31 is switched to the open position. In addition, the throttle 22C is provided in the switch position (C) of the directional control valve 22. Because of this, the pressurized oil returning from the bottom-side oil chamber 5D4 of the hydraulic cylinder 5D through the bottom side line 17 and the directional control valve 22 to the hydraulic oil tank 14 is sufficiently throttled by the throttle 22C. Thereby, a large portion of the flow of pressurized oil out of the bottom-side oil chamber 5D4 of the hydraulic cylinder 5D is supplied (recovered) through the bottom side line 17, the recovery line 30, the recovery control valve 31 and the recovery check valve 32 into the accumulator 29.

At this time, for example, the force exerted by the self-weight of the boom 5A and the like to contract the hydraulic cylinder 5D can be utilized to accumulate (charge) the pressurized oil in the bottom-side oil chamber 5D4 of the hydraulic cylinder 5D into the accumulator 29. The pressurized oil accumulated (recovered) into the accumulator 29 is supplied to the main hydraulic circuit 11A (the main delivery line 15)-side when the main supply control valve 34 is in the open position, and is supplied to the pilot hydraulic circuit 11B (the pilot delivery line 21)-side when the pilot supply control valve 37 is in the open position. In addition, when the pressurized oil in the accumulator 29 is being supplied to the pilot hydraulic circuit 11B (the pilot delivery line 21)-side, when the unloader valve 27 is switched to the open position, the load to be applied to the engine 12 from the pilot hydraulic pump 20 can be reduced.

The main supply control valve 34, the pilot supply control valve 37 and the unloader valve 27 are controlled by the controller 39. In accordance with the pressure in the accumulator 29 (the ACC pressure) detected by the accumulator-side pressure sensor 38, and the presence or absence (the operation lever signal) of the operation of the lever operating device 23 detected by the operation detection sensor 23A, the controller 39 controls the opening and closing of the main supply control valve 34, the opening and closing of the pilot supply control valve 37 and the opening and closing of the unloader valve 27.

Next, an explanation will be made of the control processing of the controller 39 with reference to FIG. 3. It should be noted that the control processing in FIG. 3 is executed repeatedly in a predetermined control cycle during energization of the controller 39, for example.

For example, when the power supply to the controller 39 is started by turning on a key switch or the like, the controller 39 initiates the control processing (the arithmetic processing) in FIG. 3. The controller 39 determines at S1 whether or not the ACC pressure which is the pressure in the accumulator 29 exceeds the set pressure 1 which is the preset first set pressure (ACC pressure>set pressure 1). For the ACC pressure, the pressure detected by the accumulator-side pressure sensor 38 can be used.

When the ACC pressure is higher, in a case where the pressurized oil in the accumulator 29 is returned to the pilot hydraulic circuit 11B (the pilot delivery line 21-side), a greater loss of pressure may occur in the pilot supply control valve 37, and in turn the energy (the pressurized oil) may possibly not be effectively used. To avoid this, at S1, in a case where the ACC pressure exceeds the set pressure 1, the pressurized oil in the accumulator 29 is determined to be returned to the main hydraulic circuit 11A (the main delivery line 15)-side, and in a case where the ACC pressure is lower than the set pressure 1, the pressurized oil in the accumulator 29 is determined to be returned to the pilot hydraulic circuit 11B (the pilot delivery line 21)-side. It should be noted that the set pressure 1 may be set to a pressure slightly higher (for example, higher by approximately 0.5 to 1 MPa) than the pressure (the primary pressure) in the pilot hydraulic circuit 11B (the pilot delivery line 21).

In a case where "YES" is determined at S1, that is, in a case where it is determined at S1 that the ACC pressure exceeds the set pressure 1, the process goes to S2. At S2, it is determined whether or not the lever operating device 23 is operated (whether or not an operation lever signal is detected). That is, it is determined at S2 whether or not an operation lever signal indicating that the lever operating device 23 is operated is input from the operation detection sensor 23A to the controller 39.

It is determined at S2 whether or not the pressurized oil in the accumulator 29 can be returned to the main hydraulic circuit 11A (the main delivery line 15)-side, based on an instruction of an operation lever signal. That is, in a case where there is no input of the operation lever signal (in a case where the lever operating device 23 is not operated), this means a state where the hydraulic cylinder 5D is not working. In this state, even when the pressurized oil in the accumulator 29 is supplied to the main hydraulic circuit 11A (the main delivery line 15)-side, the energy (the pressurized oil) may possibly not be effectively utilized. To avoid this, at S2, the presence or absence of the operation lever signal (the operation of the lever operating device 23) is determined to supply the pressurized oil in the accumulator 29 to the main hydraulic circuit 11A (the main delivery line 15)-side when the hydraulic cylinder 5D is working.

In a case where "YES" is determined at S2, that is, in a case where it is determined at S2 that the operation lever signal is detected (the lever operating device 23 is operated), the process goes to S3. At S3, the main supply control valve 34 is switched to the open position, and the pilot supply control valve 37 and the unloader valve 27 are switched to the closed position. In this way, the pressurized oil in the accumulator 29 is supplied to the main hydraulic circuit 11A (the main delivery line 15)-side, and thus, enabling effective utilization of the pressurized oil in the accumulator 29. At S3, after the main supply control valve 34 is switched to the open position and the pilot supply control valve 37 and the unloader valve 27 are switched to the closed position, the process returns (to "start", which is then repeated from the processing in S1 onward).

On the other hand, in a case where "NO" is determined at S2, that is, in a case where it is determined at S2 that the operation lever signal is not detected (the lever operating device 23 is not operated), the process goes to S4. At S4, the main supply control valve 34, the pilot supply control valve 37 and the unloader valve 27 are switched to the closed position. That is, in this case, the hydraulic cylinder 5D is not working, and therefore, the pressurized oil in the accumulator 29 is not supplied to the main hydraulic circuit 11A (the main delivery line 15)-side. At S4, after the main supply control valve 34, the pilot supply control valve 37 and the unloader valve 27 are switched to the closed position, the process returns.

On the other hand, in a case where "NO" is determined at S1, that is, in a case where it is determined at S1 that the ACC pressure, which is the pressure in the accumulator 29, is below the set pressure 1, the process goes to S5. That is, in a case where it is determined that, due to a low ACC pressure, supplying the pressurized oil in the accumulator 29 to the pilot hydraulic circuit 11B (the pilot delivery line 21)-side can provide more efficient utilization of energy, the process goes to S5. At S5, it is determined whether or not the ACC pressure exceeds the set pressure 2 which is the preset second set pressure (ACC pressure>set pressure 2). It should be noted that, for example, the set pressure 2 may be set as a pressure slightly lower (for example, lower by approximately 0.5 MPa) than the pressure (the primary pressure) in the pilot hydraulic circuit 11B (the pilot delivery line 21).

In a case where "YES" is determined at S5, that is, in a case where it is determined at S5 that the ACC pressure exceeds the set pressure 2, the process goes to S6. At S6, the main supply control valve 34 is switched to the closed position, and the pilot supply control valve 37 and the unloader valve 27 are switched to the open position. In this way, the pressurized oil in the pilot hydraulic pump 20 is unloaded through the unloader valve 27, so that the output of the pilot hydraulic pump 20 can be suppressed to reduce the fuel consumption of the engine 12. Further, when the lever operating device 23 is operated (when the pressurized oil is required for the pilot line), the pressurized oil is supplied from the accumulator 29 through the pilot supply control valve 37 to the lever operating device 23. Therefore, in the lever operating device 23, the pilot pressure (the secondary pressure) is supplied from the pilot valve to the directional control valve 22 in conjunction with the lever. In this way, the switching position of the directional control valve 22 is switched, and thereby, making it possible to achieve the movement desired by the operator. At S6, after the main supply control valve 34 is switched to the closed position, and the pilot supply control valve 37 and the unloader valve 27 are switched to the open position, the process returns.

On the other hand, in a case where "NO" is determined at S5, that is, in a case where it is determined at S5 that the ACC pressure is equal to or lower than the set pressure 2, the process goes to S7. At S7, the main supply control valve 34 and the unloader valve 27 are switched to the closed position, and the pilot supply control valve 37 is switched to the open position. In this way, the pressurized oil in the pilot hydraulic pump 20 is supplied through the check valve 28 and the pilot supply control valve 37 to the accumulator 29. Along with this, the pressurized oil in the pilot hydraulic pump 20 is also supplied to the lever operating device 23.

As a result, a required pressurized oil for the lever operating device 23 can be ensured and also the accumulation (charging) in the accumulator 29 is made possible. The accumulator 29 is accumulated (charged) with the pressurized oil in the pilot hydraulic pump 20 until reaching, for example, a pressure which is slightly lower than (for example, lower by approximately 0.2 MPa than the valve opening pressure) the valve opening pressure of the relief valve 26. Thereby, the pressurized oil can be suppressed from escaping from the relief valve 26 (the abandoning energy). At S7, after the main supply control valve 34 and the unloader valve 27 are switched to the closed position, and the pilot supply control valve 37 is switched to the open position, the process returns.

In this manner, according to the first embodiment, the main supply control valve 34 (the main circuit supply device) is included in addition to the pilot supply control valve 37 (the pilot circuit supply device). Therefore, the highly pressurized oil, which is recovered into the accumulator 29 (the accumulator) through the recovery control valve 31 (the recovery device), can be supplied not only to the pilot hydraulic circuit 11B (the pilot delivery line 21) but also to the main hydraulic circuit 11A (the main delivery line 15). That is, when the pressurized oil in the accumulator 29 is under high pressure, the pressurized oil can be supplied to the main hydraulic circuit 11A under high pressure (the recovered pressurized oil can be returned), and when the pressurized oil in the accumulator 29 is under low pressure, the pressurized oil can be supplied to the pilot hydraulic circuit 11B under low pressure (the recovered pressurized oil can be returned). Consequently, the efficient utilization of the recovered energy (the pressurized oil) can be enabled. In other words, the output of the pilot hydraulic pump 20 can be reduced by virtue of the return oil from the hydraulic cylinder 5D (the hydraulic actuator) (that is, the pressurized oil recovered into the accumulator 29). In addition to this, the efficient utilization of the pressurized oil recovered into the accumulator 29, that is, the energy can be achieved by returning the pressurized oil in the accumulator 29 also to the main hydraulic circuit 11A under high pressure. Consequently, it is possible to reduce the fuel consumption (enhance the fuel efficiency) of the engine 12 which drives the pilot hydraulic pump 20 and the main hydraulic pump 13, for example.

According to the first embodiment, the controller 39 (the control device) is provided. When the pressurized oil in the accumulator 29 is under high pressure, the controller 39 determines that the pressurized oil accumulated in the accumulator 29 should be supplied to the main hydraulic circuit 11A, and also the controller 39 controls the main supply control valve 34 (and the pilot supply control valve 37 as needed). In this way, the pressurized oil in the accumulator 29 can be supplied to the high-pressure main hydraulic circuit 11A. On the other hand, when the pressurized oil in the accumulator 29 is under low pressure, the controller 39 determines that the pressurized oil accumulated in the accumulator 29 should be supplied to the pilot hydraulic circuit 11B, and also the controller 39 controls the pilot supply control valve 37 (and the main supply control valve 34 as needed). In this way, the pressurized oil in the accumulator 29 can be supplied to the low-pressure pilot hydraulic circuit 11B.

According to the first embodiment, the recovery control valve 31 (a first control valve), the main supply control valve 34 (a second control valve) and the pilot supply control valve (a third control valve) are provided. Therefore, the pressurized oil discharged from the hydraulic cylinder 5D can be recovered into the accumulator 29 through the recovery control valve 31. In addition, switching the main supply control valve 34 allows the pressurized oil in the accumulator 29 to be supplied to the high-pressure main hydraulic circuit 11A. Further, switching the pilot supply control valve 37 allows the pressurized oil in the accumulator 29 to be supplied to the low-pressure pilot hydraulic circuit 11B.

According to the first embodiment, the unloader valve 27 (a pilot flow reducing device) is provided. Therefore, while the pressurized oil in the accumulator 29 is being supplied to the low-pressure pilot hydraulic circuit 11B, the unloader valve 27 can reduce the flow rate from the pilot hydraulic pump 20 to the pilot hydraulic circuit 11B. Consequently, the output of the pilot hydraulic pump 20 can be reduced and in turn the consumption of power (fuel) of the drive source (for example, the engine 12) of the pilot hydraulic pump 20 can be reduced.

According to the first embodiment, the unloader valve 27 and the check valve 28 (the non-return valve) are provided. Therefore, when the pressurized oil in the accumulator 29 is being supplied to the low pressured pilot hydraulic circuit 11B, the unloader valve 27 is used, making it possible to reduce the flow rate from the pilot hydraulic pump 20 to the pilot hydraulic circuit 11B. At this time, the pressurized oil in the accumulator 29, that is, the pressurized oil in the pilot hydraulic circuit 11B can be blocked from flowing uselessly to the unloader valve 27-side by the check valve 28. Thus, also in this respect, the efficient utilization of the pressurized oil (the energy) in the accumulator 29 can be achieved.

According to the first embodiment, the controller 39 controls the main supply control valve 34 and the pilot supply control valve 37 in accordance with the pressure in the accumulator 29 (the ACC pressure) which is detected by the accumulator-side pressure sensor 38 (the first pressure detector). In this case, the controller 39 controls the main supply control valve 34 (and the pilot supply control valve 37 as needed) when the pressurized oil in the accumulator 29 detected by the accumulator-side pressure sensor 38 (the ACC pressure) is high. In this way, the highly pressurized oil accumulated in the accumulator 29 can be supplied to the main hydraulic circuit 11A. On the other hand, the controller 39 controls the pilot supply control valve 37 (and the main supply control valve 34 as needed) when the pressurized oil in the accumulator 29 detected by the accumulator-side pressure sensor 38 (the ACC pressure) is low. In this way, the low pressurized oil accumulated in the accumulator 29 can be supplied to the pilot hydraulic circuit 11B.

According to the first embodiment, when the pressurized oil in the accumulator 29 detected by the accumulator-side pressure sensor 38 is higher than the first set pressure (the set pressure 1), the controller 39 can supply the pressurized oil accumulated in the accumulator 29 to the main hydraulic circuit 11A. On the other hand, when the pressurized oil in the accumulator 29 detected by the accumulator-side pressure sensor 38 is lower than the first set pressure (the set pressure 1), the controller 39 can supply the pressurized oil accumulated in the accumulator 29 to the pilot hydraulic circuit 11B. Therefore, appropriately setting the first set pressure (the set pressure 1) enables efficient supply of the pressurized oil (energy) in the accumulator 29 to the main hydraulic circuit 11A and the pilot hydraulic circuit 11B.

According to the first embodiment, when the pressure in the accumulator 29 is lower than the first set pressure (the set pressure 1) and also higher than the second set pressure (the set pressure 2), the controller 39 controls the unloader valve 27 to reduce the flow rate into the pilot hydraulic circuit 11B. Thus, when the pressure in the accumulator 29 is lower than the first set pressure (the set pressure 1) and higher than the second set pressure (the set pressure 2), a reduction in the output of the pilot hydraulic pump 20 can be achieved. Consequently, the consumption of power (fuel) of the drive source (for example, the engine 12) of the pilot hydraulic pump 20 can be reduced.

Figure 4:
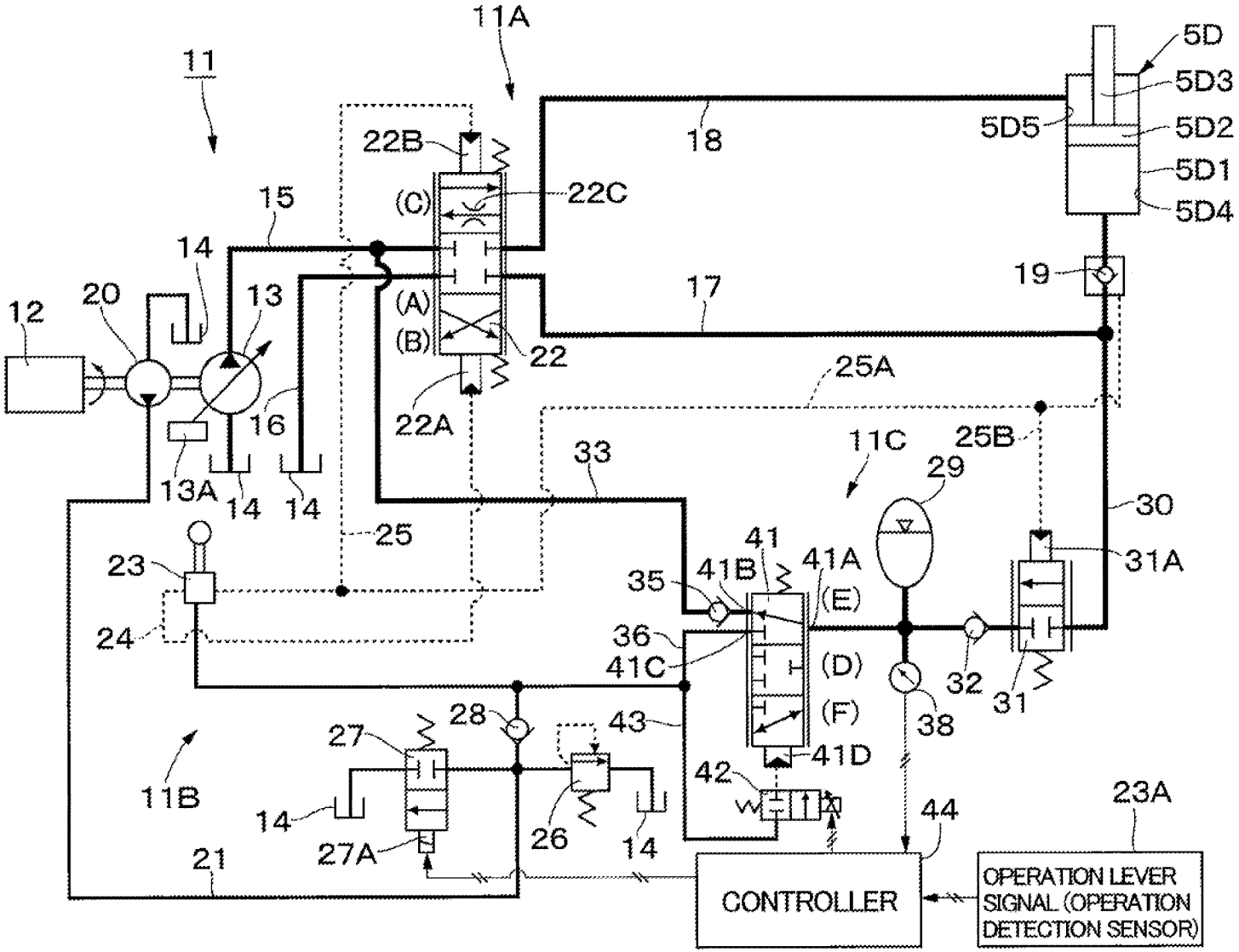
FIG. 4 is a hydraulic circuit diagram of the hydraulic excavator according to a second embodiment.
Figure 5:
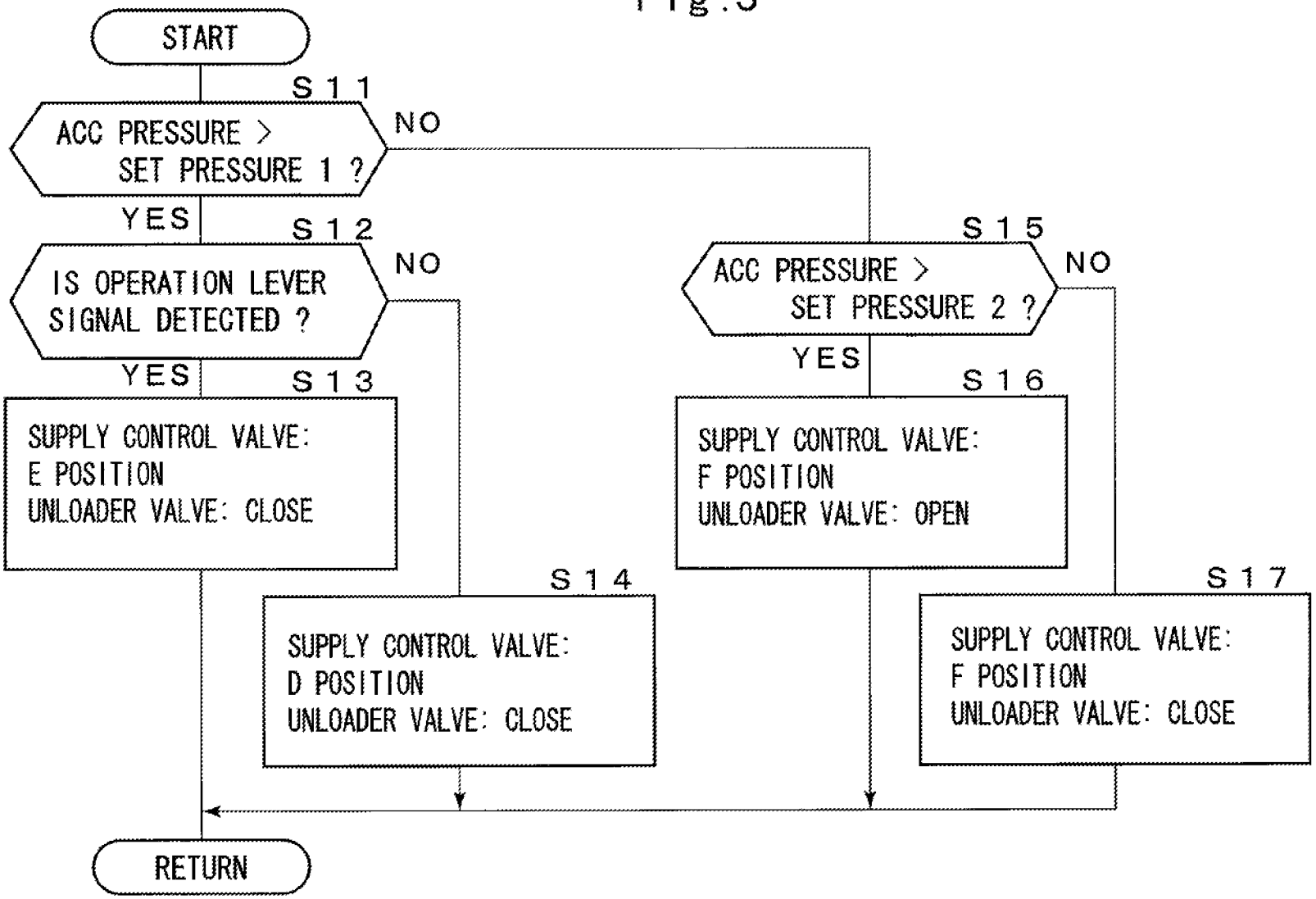
FIG. 5 is a flow chart showing the processing in the controller shown in FIG. 4.

Next, FIG. 4 and FIG. 5 show a second embodiment. The second embodiment is characterized in that a main circuit supply device and a pilot circuit supply device each are configured of a first directional control valve. That is, in place of the second control valve (the main supply control valve 34) and the third control valve (the pilot supply control valve 37) in the first embodiment, the second embodiment is provided with a first directional control valve (a supply control valve 41) which is a single directional control valve, and an electromagnetic valve (an electromagnetic proportional valve 42) for switching the first directional control valve. It should be noted that, in the second embodiment, components identical to those in the first embodiment are referred to as identical reference numerals, and an explanation thereof is omitted.

The recovery hydraulic circuit 11C of the hydraulic circuit 11 is provided with the accumulator 29 serving as an accumulator, the recovery control valve 31 serving as a recovery device and a first control valve, a supply control valve 41, an electromagnetic proportional valve 42 (a first electromagnetic proportional valve), the accumulator-side pressure sensor 38 serving as a first pressure detector, and a controller 44 serving as a control device.

The supply control valve 41 forms a main circuit supply device that supplies pressurized oil accumulated in the accumulator 29 to the main hydraulic circuit 11A (the main delivery line 15), and a pilot circuit supply device that supplies the pressurized oil accumulated in the accumulator 29 to the pilot hydraulic circuit 11B (the pilot delivery line 21). That is, the supply control valve 41 is a first directional control valve having a switch position (D) as a neutral position or a block position, a switch position (E) as a first connection position, and a switch position (F) as a second connection position.

The supply control valve 41 is configured of, for example, a hydraulic pilot switching valve of a 3-port and a 3-position. A first port 41A of the supply control valve 41 is connected to the accumulator 29 through the recovery line 30. A second port 41B of the supply control valve 41 is connected to the pilot hydraulic circuit 11B (the pilot delivery line 21) through the main regeneration line 33. A third port 41C of the supply control valve 41 is connected to the pilot hydraulic circuit 11B (the pilot delivery line 21) through the pilot regeneration line 36.

In addition, the supply control valve 41 has a single hydraulic pilot portion 41D. A pilot pressure is supplied to the hydraulic pilot portion 41D of the supply control valve 41 through the electromagnetic proportional valve 42. That is, by supplying the pilot pressure to the hydraulic pilot portion 41D through the electromagnetic proportional valve 42 which is controlled by the controller 44, the supply control valve 41 is switched to any one of the switch position (D), the switch position (E) and the switch position (F).

In this case, upon switching to the switch position (E), the supply control valve 41 connects the accumulator 29 and the main hydraulic circuit 11A (the main delivery line 15). Upon switching to the switch position (F), the supply control valve 41 connects the accumulator 29 and the pilot hydraulic circuit 11B (the pilot delivery line 21). Upon switching to the switch position (D), the supply control valve 41 breaks connection between the accumulator 29, and the main hydraulic circuit 11A (the main delivery line 15) and the pilot hydraulic circuit 11B (the pilot delivery line 21).

The electromagnetic proportional valve 42 is connected to the pilot hydraulic pump 20 through the check valve 28. The electromagnetic proportional valve 42 is also connected to the accumulator 29 when the supply control valve 41 is in the switch position (F). That is, the electromagnetic proportional valve 42 is connected through a branch line 43 to a portion of the pilot delivery line 21 downstream of the check valve 28 (more specifically, to the course of the pilot regeneration line 36). The electromagnetic proportional valve 42 receives a control signal (a current signal) from the controller 44, as input. On this account, the electromagnetic proportional valve 42 is connected to the controller 44. When a valve opening of the electromagnetic proportional valve 42 is adjusted in proportion to a current value of the control signal, the pilot pressure to be supplied to the hydraulic pilot portion 41D of the supply control valve 41 is varied. Thus, the supply control valve 41 is switched from the switch position (F) to the switch position (D) or the switch position (E).

The controller 44 has an input side connected to the accumulator-side pressure sensor 38 and the operation detection sensor 23A. The controller 44 has an output side connected to the electromagnetic proportional valve 42 and the unloader valve 27 serving as a pilot flow reducing device. The controller 44 determines whether the pressurized oil accumulated in the accumulator 29 should be supplied to the main hydraulic circuit 11A (the main delivery line 15) or supplied to the pilot hydraulic circuit 11B (the pilot delivery line 21). Along with this, the controller 44 controls the supply control valve 41 through the electromagnetic proportional valve 42 based on the determination result.

In this case, the controller 44 controls an opening of the electromagnetic proportional valve 42 in accordance with the pressure in the accumulator 29 detected by the accumulator-side pressure sensor 38 to control the switch position of the supply control valve 41. Additionally, the controller 44 controls the unloader valve 27 in accordance with the pressure in the accumulator 29 detected by the accumulator-side pressure sensor 38. The controller 44 has a memory and a computing circuit (CPU) as similar to the above-described controller 39 in the first embodiment. The memory has processing programs stored therein for execution of the processing flow shown in FIG. 5.

Next, an explanation will be made of the control processing of the controller 44 with reference to FIG. 5. It should be noted that since S11, S12, S15 in FIG. 5 are similar to the processing steps of S1, S2, S5 in FIG. 3 in the first embodiment, an explanation thereof is omitted. That is, the controller 44 in the second embodiment, as similar to the controller 39 in the first embodiment, determines whether the pressurized oil in the accumulator 29 should be supplied to the main hydraulic circuit 11A or supplied to the pilot hydraulic circuit 11B, in accordance with the pressure in the accumulator 29 (the ACC pressure).

In a case where "YES" is determined at S12, that is, it is determined at S12 that the operation lever signal is detected (the lever operating device 23 is operated), the process goes to S13. At S13, the supply control valve 41 is switched to the switch position (E), and the unloader valve 27 is switched to the closed position. That is, the controller 44 outputs an instruction to the electromagnetic proportional valve 42 so that the supply control valve 41 switches to the switch position (E). In this way, the pressurized oil in the accumulator 29 is supplied to the main hydraulic circuit 11A (the main delivery line 15)-side, and thus, enabling effective utilization of the pressurized oil in the accumulator 29.

On the other hand, in a case where "NO" is determined at S12, that is, it is determined at S12 that the operation lever signal is not detected (the lever operating device 23 is not operated), the process goes to S14. At S14, the supply control valve 41 is switched to the switch position (D), and the unloader valve 27 is switched to the closed position. That is, in this case, since the hydraulic cylinder 5D is not working, the pressurized oil in the accumulator 29 is not supplied to the main hydraulic circuit 11A (the main delivery line 15)-side. That is, the controller 44 outputs an instruction to the electromagnetic proportional valve 42 so that the supply control valve 41 switches to the switch position (D).

In a case where "YES" is determined at S15, that is, in a case where it is determined at S15 that the ACC pressure exceeds the set pressure 2, the process goes to S16. At S16, the supply control valve 41 is switched to the switch position (F), and the unloader valve 27 is switched to the open position. That is, the controller 44 outputs an instruction to the electromagnetic proportional valve 42 so that the supply control valve 41 switches to the switch position (F). In this way, the pressurized oil in the pilot hydraulic pump 20 is unloaded through the unloader valve 27, and thereby, making it possible to suppress the output of the pilot hydraulic pump 20 and reduce the fuel consumption of the engine 12. Further, when the lever operating device 23 is operated (when the pressurized oil is required for the pilot line), the pressurized oil is supplied from the accumulator 29 through the supply control valve 41 to the lever operating device 23. Therefore, in the lever operating device 23, the pilot pressure (the secondary pressure) is supplied from the pilot valve to the directional control valve 22 in conjunction with the lever. Thereby, the switch position of the directional control vale 22 is switched to enable the movement desired by the operator.

On the other hand, in a case where "NO" is determined at S15, that is, in a case where it is determined at S15 that the ACC pressure is equal to or lower than the set pressure 2, the process goes to S17. At S17, the supply control valve 41 is switched to the switch position (F), and the unloader valve 27 is switched to the closed position. In this way, the pressurized oil in the pilot hydraulic pump 20 is supplied through the check valve 28 and the supply control valve 41 to the accumulator 29. Along with this, the pressurized oil in the pilot hydraulic pump 20 is also supplied to the lever operating device 23. As a result, a required pressurized oil for the lever operating device 23 can be ensured and also the accumulation (charging) in the accumulator 29 can be accomplished.

The second embodiment is configured such that the controller 44 as described above controls the supply control valve 41 through the electromagnetic proportional valve 42, and the second embodiment does not differ particularly in a basic function from the first embodiment as described above. That is, also the second embodiment, as similar to the first embodiment, returns the pressurized oil to the high-pressure main hydraulic circuit 11A when the pressurized oil in the accumulator 29 is under high pressure. When the pressurized oil in the accumulator 29 is under low pressure, the pressurized oil is returned to the low-pressure pilot hydraulic circuit 11B to reduce the output of the pilot hydraulic pump 20. In this way, the efficient utilization of the recovered energy (the pressurized oil) can be achieved.

In particular, the second embodiment is provided with the recovery control valve 31 (the first control valve) and the supply control valve 41 (the first directional control valve). Therefore, the pressurized oil discharged from the hydraulic cylinder 5D (the hydraulic actuator) can be recovered into the accumulator 29 through the recovery control valve 31. Also, switching the supply control valve 41 to the switch position (E) as the first connection position allows the pressurized oil in the accumulator 29 to be supplied to the high-pressure main hydraulic circuit 11A (the main delivery line 15). Further, switching the supply control valve 41 to the switch position (F) as the second connection position allows the pressurized oil in the accumulator 29 to be supplied to the low-pressure pilot hydraulic circuit 11B (the pilot delivery line 21).

Also, in the aforementioned first embodiment, two control valves (that is, the main supply control valve 34 and the pilot supply control valve 37) are needed for switching supply destinations of the pressurized oil in the accumulator 29. In contrast to this, the second embodiment can be configured of a single control valve (the supply control valve 41) and a single small-sized electromagnetic valve (the electromagnetic proportional valve 42) for adjusting the pilot pressure. Consequently, as compared with the first embodiment, the hydraulic equipment and the line arrangement can be made smaller in size (the downsizing can be achieved).

It should be noted that, the first embodiment is explained by taking a case where the main supply control valve 34 and the pilot supply control valve 37 are electromagnetic pilot switching valves, as an example. However, the present invention is not limited thereto, but for example, a combination of a hydraulic pilot directional control valve and an electromagnetic proportional valve as described in the second embodiment may be provided. That is, the main supply control valve may be configured of a combination of a hydraulic pilot control valve and an electromagnetic proportional valve, and also the pilot supply control valve may be configured of a combination of a hydraulic pilot control valve and an electromagnetic proportional valve. Such a configuration is generally used because of easiest availability of valves.

In this case, the two control valves and the two electromagnetic proportional valves are needed, but in the second embodiment, only one directional control valve and only one electromagnetic proportional valve are needed. Therefore, the circuit can be more simply configured, making it possible to achieve a reduction in costs and an improvement on mountability. In addition, in the second embodiment, a combination of the supply control valve 41 and electromagnetic proportional valve 42 is adopted, but without limiting to this, for example, the supply control valve 41 may be configured of an electromagnetic pilot directional control valve driving directly electrically rather than the pilot system. In this case, more unsophistication and more simplification can be achieved for the circuit.

Figure 6:
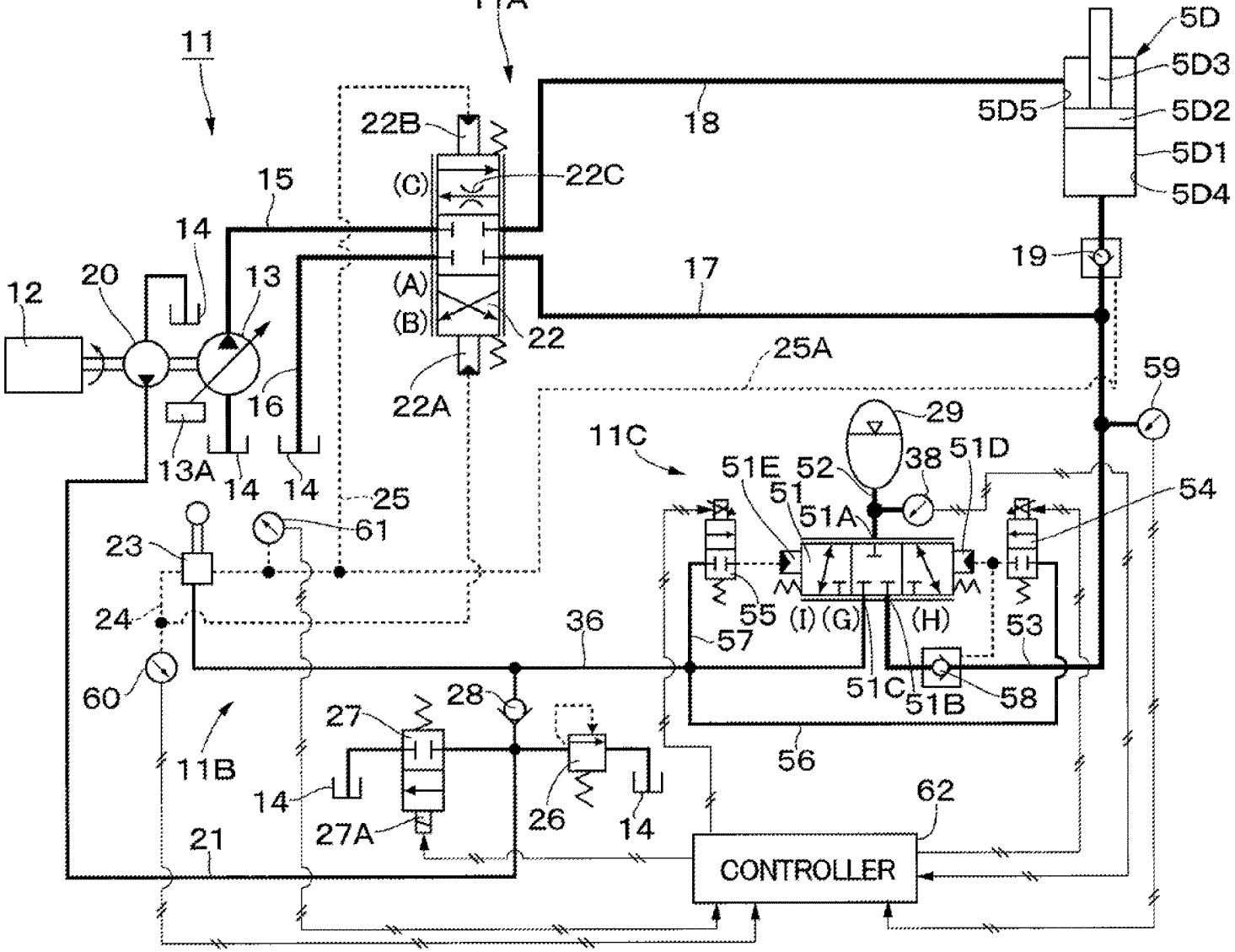
FIG. 6 is a hydraulic circuit diagram of the hydraulic excavator according to a third embodiment.

A third embodiment will now be described with reference to FIG. 6 and FIG. 7. The third embodiment is characterized in that a second directional control valve forms the recovery device, the main circuit supply device and the pilot circuit supply device. That is, in place of the first control valve (the recovery control valve 31), the second control valve (the main supply control valve 34) and the third control valve (the pilot supply control valve 37) in the first embodiment, the third embodiment includes a second directional control valve (a recovery supply control valve 51) which is a single directional control valve, and two electromagnetic valves (electromagnetic proportional valves 54, 55) for switching the second directional control valve. It should be noted that, in the third embodiment, components identical to those in the aforementioned first embodiment are referred to as identical reference numerals, and an explanation thereof is omitted.

The recovery hydraulic circuit 11C of the hydraulic circuit 11 includes the accumulator 29 serving as an accumulator, the recovery supply control valve 51 serving as "the recovery device, the main supply device and the pilot supply device", the one-side electromagnetic proportional valve 54 (a second electromagnetic proportional valve), the other-side electromagnetic proportional valve 55 (a third electromagnetic proportional valve), a pilot check valve 58 (a second pilot check valve), the accumulator-side pressure sensor 38 serving as a first pressure detector, a bottom-side pressure sensor 59, an extending operation side pressure sensor 60, a contracting operation side pressure sensor 61, and a controller 62 serving as a control device.

The recovery supply control valve 51 forms the recovery device that recovers the pressurized oil discharged from the hydraulic cylinder 5D into the accumulator 29, the main circuit supply device that supplies the pressurized oil accumulated in the accumulator 29 to the main hydraulic circuit 11A (the bottom side line 17), and the pilot circuit supply device that supplies the pressurized oil accumulated in the accumulator 29 to the pilot hydraulic circuit 11B (the pilot delivery line 21). That is, the recovery supply control valve 51 is a second directional control valve having a neutral position (G) corresponding to a block position, a switch position (H) corresponding to a third connection position and a switch position (I) corresponding to a fourth connection position.

The recovery supply control valve 51 is configured of, for example, a hydraulic pilot switching valve of a 3-port and a 3-position. A first port 51A of the recovery supply control valve 51 is connected to the accumulator 29 through an accumulation line 52. The accumulation line 52 connects the accumulator 29 and the recovery supply control valve 51 to each other. A second port 51B of the recovery supply control valve 51 is connected to the main hydraulic circuit 11A (the bottom side line 17, that is, the bottom-side oil chamber 5D4 of the hydraulic cylinder 5D) through a recovery supply line 53. The recovery supply line 53 connects the main hydraulic circuit 11A and the recovery supply control valve 51 to each other. A third port 51C of the recovery supply control valve 51 is connected to the pilot hydraulic circuit 11B (the pilot delivery line 21) through the pilot regeneration line 36.

The recovery supply control valve 51 has two hydraulic pilot parts 51D, 51E. A pilot pressure is supplied to one hydraulic pilot part 51D of the recovery supply control valve 51 through the one-side electromagnetic proportional valve 54. A pilot pressure is supplied to the other hydraulic pilot part 51E of the recovery supply control valve 51 through the other-side electromagnetic proportional valve 55. That is, in recovery supply control valve 51, the pilot pressure is supplied to the hydraulic pilot parts 51D, 51E through the one-side electromagnetic proportional valve 54 and the other-side electromagnetic proportional valve 55 which are controlled by the controller 62. Thereby, the recovery supply control valve 51 is switched to any one of the neutral position (G), the switch position (H) and the switch position (I).

In this case, upon switching to the switch position (H), the recovery supply control valve 51 connects the accumulator 29 and the main hydraulic circuit 11A (the bottom side line 17). That is, the switch position (H) of the recovery supply control valve 51 corresponds to the third connection position where the connection between the hydraulic cylinder 5D (the hydraulic actuator) and the accumulator 29 is established, and thus, forming the recovery device and the main circuit supply device. On the other hand, upon switching to the switch position (I), the recovery supply control valve 51 connects the accumulator 29 and the pilot hydraulic circuit 11B (the pilot delivery line 21). That is, the switch position (I) of the recovery supply control valve 51 corresponds to the fourth connection position where the connection between the accumulator 29 and the pilot hydraulic circuit 11B (the pilot delivery line 21) is established, and thus, forming the pilot circuit supply device.

On the other hand, upon switching to the neutral position (G) corresponding to the block position, the recovery supply control valve 51 breaks the connection between the accumulator 29 and both the main hydraulic circuit 11A (the bottom side line 17) and the pilot hydraulic circuit 11B (the pilot delivery line 21). In this manner, in the third embodiment, the recovery device, the main circuit supply device and the pilot circuit supply device are configured of the recovery supply control valve 51 which is a single directional control valve.

The electromagnetic proportional valves 54, 55 are connected to the pilot hydraulic pump 20 through the check valve 28. The electromagnetic proportional valves 54, 55 are also connected to the accumulator 29 when the recovery supply control valve 51 is in the switch position (I). That is, the one-side electromagnetic proportional valve 54 and the other-side electromagnetic proportional valve 55 are connected respectively through an one-side branch line 56 and an other-side branch line 57 to a portion of the pilot delivery line 21 downstream of the check valve 28 (more specifically, to the course of the pilot regeneration line 36).

The electromagnetic proportional valves 54, 55 receive a control signal (a current signal) from the controller 62 as input. A valve opening of each of the electromagnetic proportional valves 54, 55 is adjusted in proportion to a current value of the control signal. For example, upon output of an instruction from the controller 62 to the one-side electromagnetic proportional valve 54, the pilot pressure is supplied to the hydraulic pilot part 51D of the recovery supply control valve 51 through the one-side electromagnetic proportional valve 54. Thus, the recovery supply control valve 51 is switched from the neutral position (G) to the switch position (H). On the other hand, upon output of an instruction from the controller 62 to the other-side electromagnetic proportional valve 55, the pilot pressure is supplied to the hydraulic pilot part 51E of the recovery supply control valve 51 through the other-side electromagnetic proportional valve 55. Thus, the recovery supply control valve 51 is switched from the neutral position (G) to the switch position (I).

The pilot check valve 58 is provided in the course of the recovery supply line 53 (that is, between the recovery supply control valve 51 and a connecting part of the recovery supply line 53 to the bottom side line 17). The pilot check valve 58 is subjected to a pilot pressure through the one-side electromagnetic proportional valve 54. The pilot check valve 58 allows the pressurized oil to flow from the bottom side line 17 (the bottom-side oil chamber 5D4 of the hydraulic cylinder 5D)-side toward the recovery supply control valve 51-side, and blocks the pressurized oil from flowing from the recovery supply control valve 51-side toward the bottom side line 17-side. The pilot check valve 58 also allows the pressurized oil to flow from the recovery supply control valve 51-side toward the bottom side line 17-side when the pilot pressure is supplied to the pilot check valve 58 (that is, the recovery supply control valve 51 is switched to the switch position (H)).

That is, the pilot check valve 58 prevents a leak from the accumulator 29-side from flowing into the bottom-side oil chamber 5D4 of the hydraulic cylinder 5D to cause an accidental extending movement of the hydraulic cylinder 5D. On the other hand, upon supply of the pilot pressure to the pilot check valve 58 through the one-side electromagnetic proportional valve 54, the pilot check valve 58 is opened by being pressurized. Thus, the pressurized oil from the accumulator 29-side flows to the bottom-side oil chamber 5D4 of the hydraulic cylinder 5D.

The bottom-side pressure sensor 59 is provided in the course of the recovery supply line 53. The bottom-side pressure sensor 59 detects a pressure in the recovery supply line 53 (the pressure in the bottom side line 17 corresponding to the bottom-side oil chamber 5D4 of the hydraulic cylinder 5D), and then outputs the detected pressure signal to the controller 62. For this purpose, the bottom-side pressure sensor 59 is connected to the controller 62 and outputs the detected pressure (a signal corresponding to this) to the controller 62.

The extending operation side pressure sensor 60 and the contracting operation side pressure sensor 61 are connected to the controller 62. The extending operation side pressure sensor 60 is provided in the course of the extending-side pilot line 24. The extending operation side pressure sensor 60 detects a pressure (a secondary pressure) in the extending-side pilot line 24, that is, a pilot pressure Pu to be supplied to the hydraulic pilot part 22A of the directional control valve 22, and then outputs the detected pressure signal to the controller 62. The pilot pressure Pu results from the operation on the lever operating device 23 in the direction of extending the hydraulic cylinder 5D (the raising movement of the boom 5A).

The contracting operation side pressure sensor 61 is provided in the course of the contracting-side pilot line 25. The contracting operation side pressure sensor 61 detects a pressure (a secondary pressure) in the contracting-side pilot line 25, that is, a pilot pressure Pd to be supplied to the hydraulic pilot part 22B of the directional control valve 22, and then outputs the detected pressure signal to the controller 62. The pilot pressure Pd results from the operation on the lever operating device 23 in the direction of contracting the hydraulic cylinder 5D (the lowering movement of the boom 5A).

The controller 62 has an input side connected to the accumulator-side pressure sensor 38, the bottom-side pressure sensor 59, the extending operation side pressure sensor 60 and the contracting operation side pressure sensor 61. The controller 62 has an output side connected to the electromagnetic proportional valves 54, 55 and the unloader valve 27. The controller 44 controls the electromagnetic proportional valves 54, 55 in accordance with the pressure of the accumulator-side pressure sensor 38, the pressure of the bottom-side pressure sensor 59 and the operation of the lever operating device 23 (the pressure of the extending operation side pressure sensor 60 and the pressure of the contracting operation side pressure sensor 61). Thus, the controller 44 controls the switch position of the recovery supply control valve 51. The controller 62 also controls the unloader valve 27. In this case, the memory of the controller 62 has the processing program stored therein to execute the processing flow shown in FIG. 7.

Here, for example, when the lever operating device 23 is operated in the direction of extending the hydraulic cylinder 5D (that is, the raising operation to raise the boom 5A is performed), the raising pilot pressure Pu is supplied from the lever operating device 23 to the hydraulic pilot part 22A of the directional control valve 22. Thus, the directional control valve 22 switches from the neutral position (A) to the switch position (B). The raising pilot pressure Pu is detected by the extending operation side pressure sensor 60, further, the pressure in the accumulator 29 (the ACC pressure) is detected by the accumulator-side pressure sensor 38, and the bottom pressure in the hydraulic cylinder 5D (the BM pressure) is detected by the bottom-side pressure sensor 59. The detection values (signals corresponding to them) of the sensors 60, 38, 59 are input to the controller 62.

The controller 62 makes a comparison between the pressure in the accumulator 29 (the ACC pressure) and the bottom pressure in the hydraulic cylinder 5D (the BM pressure). Then, in a case where the pressure in the accumulator 29 (the ACC pressure) is higher, the controller 62 outputs an instruction to the electromagnetic proportional valve 54. Thereby, the pilot pressure is supplied to the hydraulic pilot part 51D of the recovery supply control valve 51 and the pilot check valve 58, so that the recovery supply control valve 51 switches to the switch position (H) and also the pilot check valve 58 is made open. As a result, the pressurized oil in the accumulator 29, together with the pressurized oil of the main hydraulic pump 13, is supplied to the bottom-side oil chamber 5D4 of the hydraulic cylinder 5D to initiate the extending movement of the hydraulic cylinder 5D.

On the contrary, when the lever operating device 23 is operated in the direction of contracting the hydraulic cylinder 5D (that is, the lowering operation to lower the boom 5A is performed), the lowering pilot pressure Pd is supplied from the lever operating device 23 to the hydraulic pilot part 22B of the directional control valve 22. Thus, the directional control valve 22 switches from the neutral position (A) to the switch position (C). The lower pilot pressure Pd is detected by the contracting operation side pressure sensor 61, and the pressure in the accumulator 29 (the ACC pressure) is detected by the accumulator-side pressure sensor 38, and the bottom pressure in the hydraulic cylinder 5D (the BM pressure) is detected by the bottom-side pressure sensor 59. The detection values (signals corresponding to them) of the sensors 61, 38, 59 are input to the controller 62.

The controller 62 makes a comparison between the pressure in the accumulator 29 (the ACC pressure) and the bottom pressure in the hydraulic cylinder 5D (the BM pressure). Then, in a case where the bottom pressure in the hydraulic cylinder 5D (the BM pressure) is higher, the controller 62 outputs an instruction to the electromagnetic proportional valve 54. Thereby, the pilot pressure is supplied to the hydraulic pilot part 51D of the recovery supply control valve 51, so that the recovery supply control valve 51 switches to the switch position (H). As a result, the pressurized oil in the bottom-side oil chamber 5D4 of the hydraulic cylinder 5D flows into the accumulator 29, so that the above pressurized oil is recovered into the accumulator 29, and the hydraulic cylinder 5D performs the contracting movement.

Next, an explanation will be made of the control processing of the controller 62 with reference to FIG. 7. It should be noted that the control processing in FIG. 7 is executed repeatedly in a predetermined control cycle during energization of the controller 62, for example.

Figure 7:
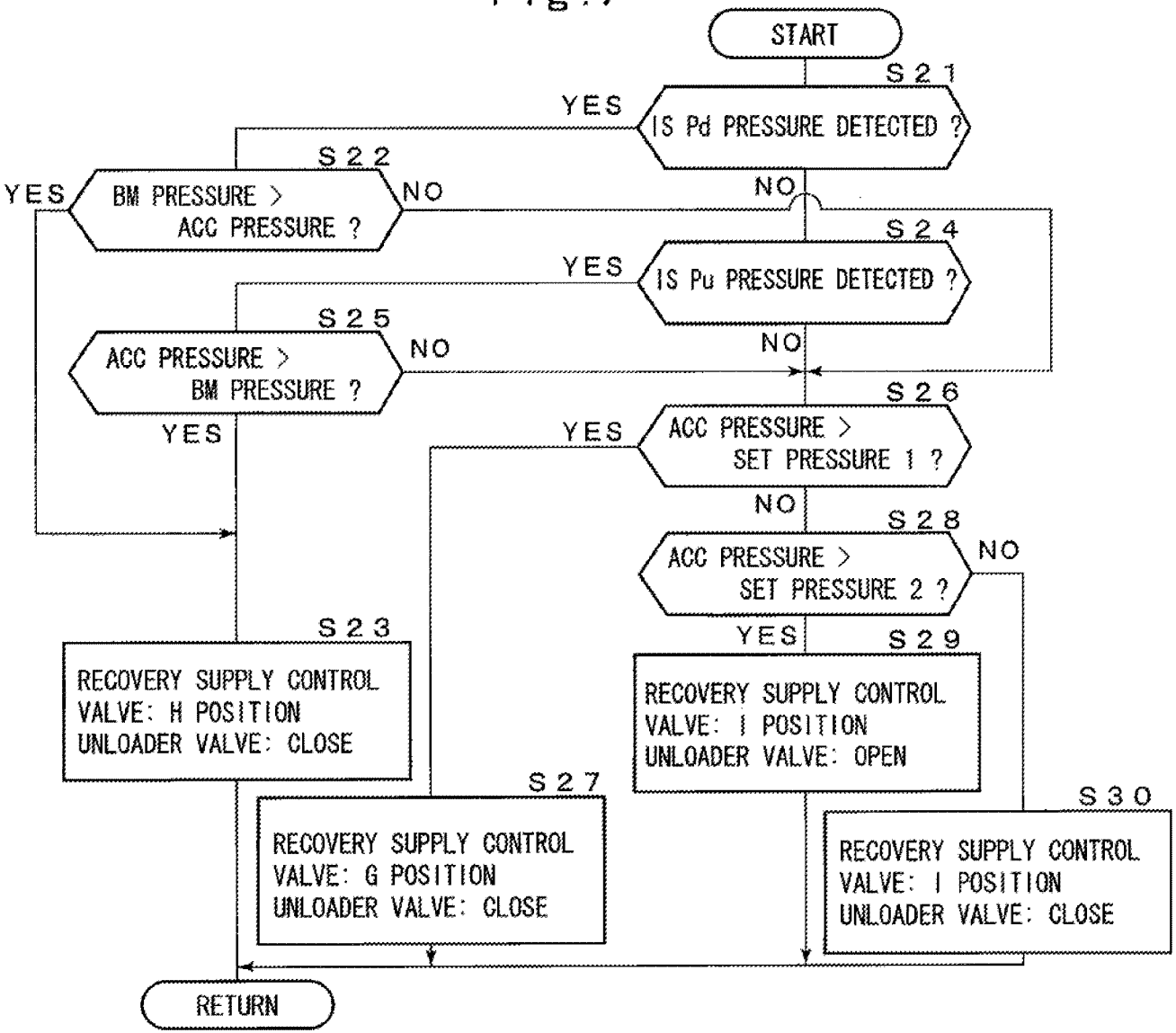
FIG. 7 is a flow chart showing the processing in the controller shown in FIG. 6.

For example, when a key switch is turned on or the like to start the power supply to the controller 62, the controller 62 initiates the control processing (the arithmetic processing) in FIG. 7. The controller 62 determines at S21 whether or not the lowering pilot pressure Pd is detected by the contracting operation side pressure sensor 61. In a case where "YES" is determined at S21, that is, in a case where it is determined that the lowering pilot pressure Pd is detected, the process goes to S22. In a case where "NO" is determined at S21, that is, in a case where it is determined that the lowering pilot pressure Pd is not detected, the process goes to S24.

It is determined at S22 whether or not the BM pressure which is the bottom pressure in the hydraulic cylinder 5D exceeds the ACC pressure which is the pressure in the accumulator 29 (BM pressure>ACC pressure). In a case where "YES" is determined at S22, that is, it is determined that the BC pressure exceeds the ACC pressure, the process goes to S23. On the other hand, in a case where "NO" is determined at S22, that is, it is determined that the BC pressure is equal to or lower than the ACC pressure, the process goes to S26.

At S23, the recovery supply control valve 51 is switched to the switch position (H), and the unloader valve 27 is switched to the closed position. That is, the controller 62 outputs an instruction to the electromagnetic proportional valve 54 so that the recovery supply control valve 51 switches to the switch position (H), and the controller 62 sends no switch single to the unloader valve 27 to control the unloader valve 27 to be close. In this case, in short, in a case where the process goes from S22 to S23, the pressurized oil in the bottom-side oil chamber 5D4 of the hydraulic cylinder 5D is supplied to (accumulated into) the accumulator 29. Here, the reason for making the comparison between the BM pressure and the ACC pressure at S22 is that, if the recovery supply control valve 51 is switched to the switch position (H) when the BM pressure is lower than the ACC pressure, then the pressurized oil in the accumulator 29 may flow backward to the bottom-side oil chamber 5D4 of the hydraulic cylinder 5D, and in turn this may possibly cause a reduction in contracting speed of the hydraulic cylinder 5D or cause the extending movement of the hydraulic cylinder 5D. That is, for achievement of the movement desired by the operator, the BM pressure and the ACC pressure are compared and when the BM pressure is lower than the ACC pressure, the process goes to S26 such that the recovery supply control valve 51 does not switch to the switch position (H).

At S24, it is determined whether or not the raising pilot pressure Pu is detected by the extending operation side pressure sensor 60. In a case where "YES" is determined at S24, that is, in a case where it is determined that the raising pilot pressure Pu is detected, the process goes to S25. In a case where "NO" is determined at S24, that is, in a case where it is determined that the raising pilot pressure Pu is not detected, the process goes to S26.

At S25, it is determined whether or not the ACC pressure exceeds the BM pressure (ACC pressure>BM pressure). In a case where "YES" is determined at S25, that is, it is determined that the ACC pressure exceeds the BM pressure, the process goes to S23. On the other hand, in a case where "NO" is determined at S22, that is, it is determined that the ACC pressure is equal to or lower than the BM pressure, the process goes to S26.

At S23, the recovery supply control valve 51 is switched to the switch position (H), and the unloader valve 27 is switched to the closed position. In this case, in short, in a case where the process goes from S25 to S23, the pressurized oil in the accumulator 29, together with the pressurized oil in the main hydraulic pump 13, is supplied to the bottom-side oil chamber 5D4 of the hydraulic cylinder 5D. This enables effective utilization of the pressurized oil in the accumulator 29.

Here, the reason for making the comparison between the ACC pressure and the BM pressure at S25 is that, if the recovery supply control valve 51 is switched to the switch position (H) when the ACC pressure is lower than the BM pressure, backflow of the pressurized oil may occur from the bottom-side oil chamber 5D4-side of the hydraulic cylinder 5D to the accumulator 29, and in turn this may possibly cause a reduction in extending speed of the hydraulic cylinder 5D or cause the contracting movement of the hydraulic cylinder 5D. That is, for achievement of the movement desired by the operator, the ACC pressure and the BM pressure are compared, and in a case where the ACC pressure is lower than the BM pressure, the process goes to S26 such that the recovery supply control valve 51 does not switch to the switch position (H).

At S26, it is determined whether or not the pressurized oil in the accumulator 29 should be supplied to the pilot hydraulic circuit 11B (the pilot delivery line 21). That is, as similar to S1 in FIG. 3 in the first embodiment, it is determined at S26 whether or not the ACC pressure exceeds the set pressure 1 (ACC pressure>set pressure 1). In a case where "YES" is determined at S26, that is, in a case where it is determined that the ACC pressure exceeds the set pressure 1, the process goes to S27. In a case where "NO" is determined at S26, that is, when it is determined that the ACC pressure is equal to or lower than the set pressure 1, the process goes to S28.

At S27, the recovery supply control valve 51 is switched to the neutral position (G), and the unloader valve 27 is switched to the closed position. That is, the controller 62 outputs an instruction to the electromagnetic proportional valves 54, 55 so that the recovery supply control valve 51 is switched to the neutral position (G) (a current signal is not outputted). The controller 62 sends no switch single to the unloader valve 27 and controls the unloader valve 27 to be close. Here, the reason for making the comparison between the ACC pressure and the set pressure 1 at S26 is that, although the ACC pressure is high, if the pressurized oil in the accumulator 29 is returned to the pilot hydraulic circuit 11B (the pilot delivery line 21), the loss of pressure may be increased in the recovery supply control valve 51, and in turn the energy may possibly not be effectively utilized. To avoid this, in a case where the ACC pressure is high, that is, higher than the set pressure 1, the process goes to S27 where the instruction is outputted to the electromagnetic proportional valves 54, 55 (a current signal is not output) so that the recovery supply control valve 51 switches to the neutral position (G) which is a full closed position (a block position). On the contrary, in a case where the ACC pressure is low, that is, equal to or lower than the set pressure 1, the process goes to S28.

At S28, as similar to S5 in FIG. 3 in the first embodiment, it is determined whether or not the ACC pressure exceeds the set pressure 2 (ACC pressure>set pressure 2). In a case where "YES" is determined at S28, the process goes to S29. At S29, the recovery supply control valve 51 is switched to the switch position (I), and the unloader valve 27 is switched to the open position. That is, the controller 62 outputs an instruction to the electromagnetic proportional valve 55 so that the recovery supply control valve 51 switches to the switch position (I), and the controller 62 sends a switch signal to the unloader valve 27 to open the unloader valve 27.

In this way, the pressurized oil in the pilot hydraulic pump 20 is unloaded through the unloader valve 27, so that the output of the pilot hydraulic pump 20 can be suppressed and thus, the fuel consumption of the engine 12 can be reduced. Further, when the lever operating device 23 is operated (when the pressurized oil is required in the pilot line), the pressurized oil is supplied from the accumulator 29 through the recovery supply control valve 51 to the lever operating device 23. Therefore, in the lever operating device 23, the pilot pressure (the secondary pressure) is supplied from the pilot valve to the directional control valve 22 in conjunction with the lever. In this way, the directional control valve 22 is switched between the switch positions, and thus, making it possible to achieve the movement desired by the operator.

On the other hand, in a case where "NO" is determined at S28, the process goes to S30. At S30, the recovery supply control valve 51 is switched to the switch position (I), and the unloader valve 27 is switched to the closed position. That is, the controller 62 outputs an instruction to the electromagnetic proportional valve 55 so that the recovery supply control valve 51 switches to the switch position (I), and also the controller 62 sends no switch single to the unloader valve 27, and controls the unloader valve 27 to be close. Thereby, the pressurized oil in the pilot hydraulic pump 20 is supplied to the accumulator 29 through the check valve 28 and the recovery supply control valve 51. Along with this, the pressurized oil in the pilot hydraulic pump 20 is also supplied to the lever operating device 23. The pressurized oil required for the lever operating device 23 can be ensured, and also, accumulation (charging) in the accumulator 29 can be accomplished.

In the third embodiment, the controller 62 as described above controls the recovery supply control valve 51 through the electromagnetic proportional valves 54, 55, and the third embodiment does not differ particularly in a basic function from the above-described first and second embodiments.

In particular, the third embodiment includes the recovery supply control valve 51 as a second directional control valve. Therefore, by switching the recovery supply control valve 51 to the switch position (H) corresponding to the third connection position, the pressurized oil discharged from the hydraulic cylinder 5D (the hydraulic actuator) can be recovered into the accumulator 29 and the pressurized oil in the accumulator 29 can be supplied to the high-pressure main hydraulic circuit 11A (the bottom side line 17). In addition, by switching the recovery supply control valve 51 to the switch position (I) corresponding to the fourth connection position, the pressurized oil in the accumulator 29 can be supplied to the low-pressure pilot hydraulic circuit 11B (the pilot delivery line 21).

Further, in the third embodiment, the pressurized oil recovered from the hydraulic cylinder 5D is configured to be returned to the hydraulic cylinder 5D which is the same actuator. That is, a hydraulic actuator pertinent to the recovery and a hydraulic actuator pertinent to the supply are identical with each other. Because of this, the circuit can be simplified. In addition, the three control valves (the recovery control valve 31, the main supply control valve 34 and the pilot supply control valve 37) used in the above-described first embodiment can be configured as a single control valve (the recovery supply control valve 51) and two small-sized electromagnetic valves (the electromagnetic proportional valves 54, 55) for pilot pressure adjustment. This enables the simplification of the circuit and reduced size of the hydraulic equipment and line arrangement.

It should be noted that the third embodiment is explained by taking a case of driving the recovery supply control valve 51 by a hydraulic pilot, that is, a combination of the recovery supply control valve 51 and the electromagnetic proportional valves 54, 55, as an example. However, without limiting to the above, for example, the recovery supply control valve 51 may be configured of an electromagnetic pilot directional control valve driving directly electrically rather than the pilot system. In this case, more unsophistication and more simplification can be achieved for the circuit.

Figure 8:
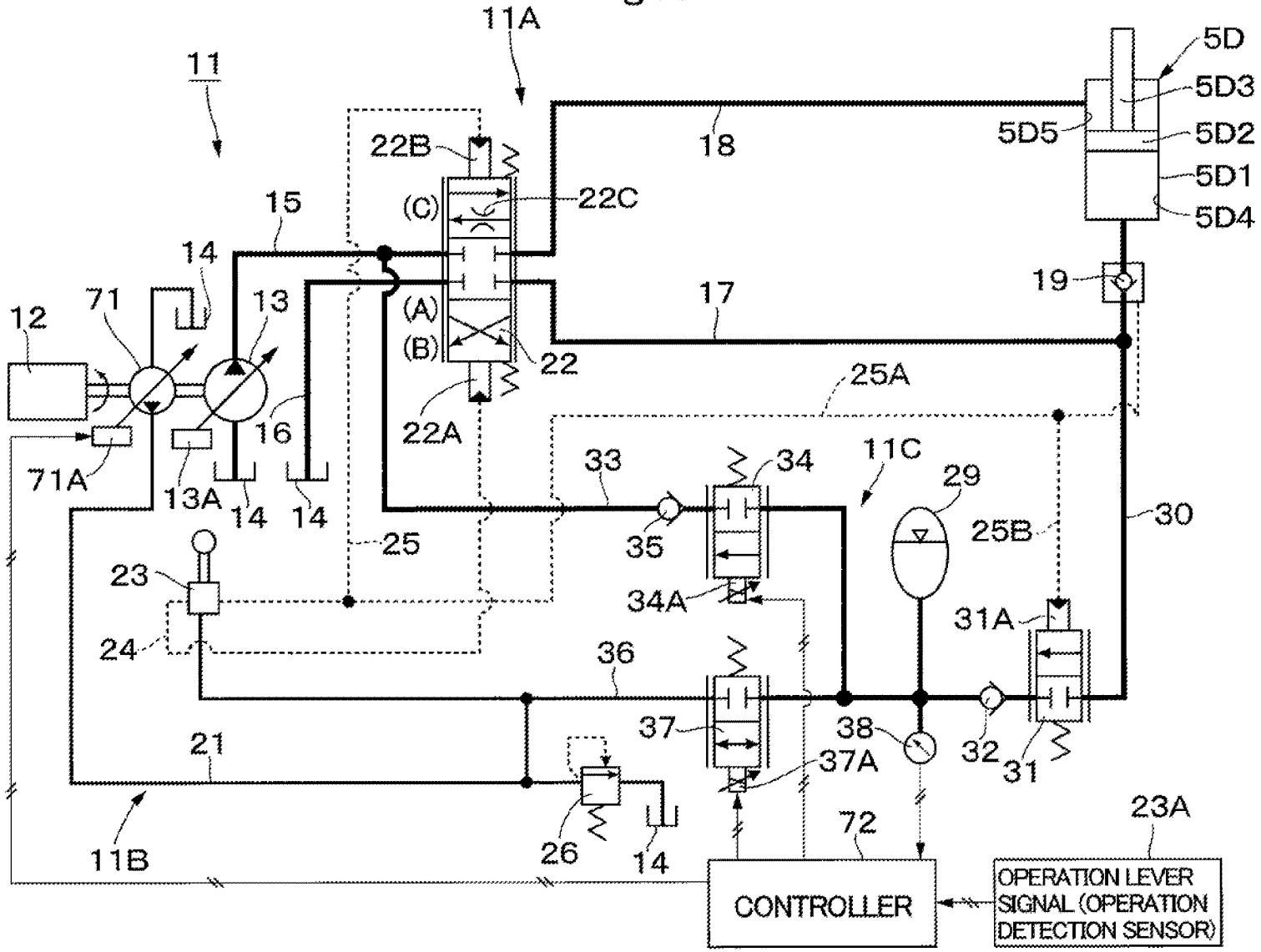
FIG. 8 is a hydraulic circuit diagram of the hydraulic excavator according to a fourth embodiment.
Figure 9:
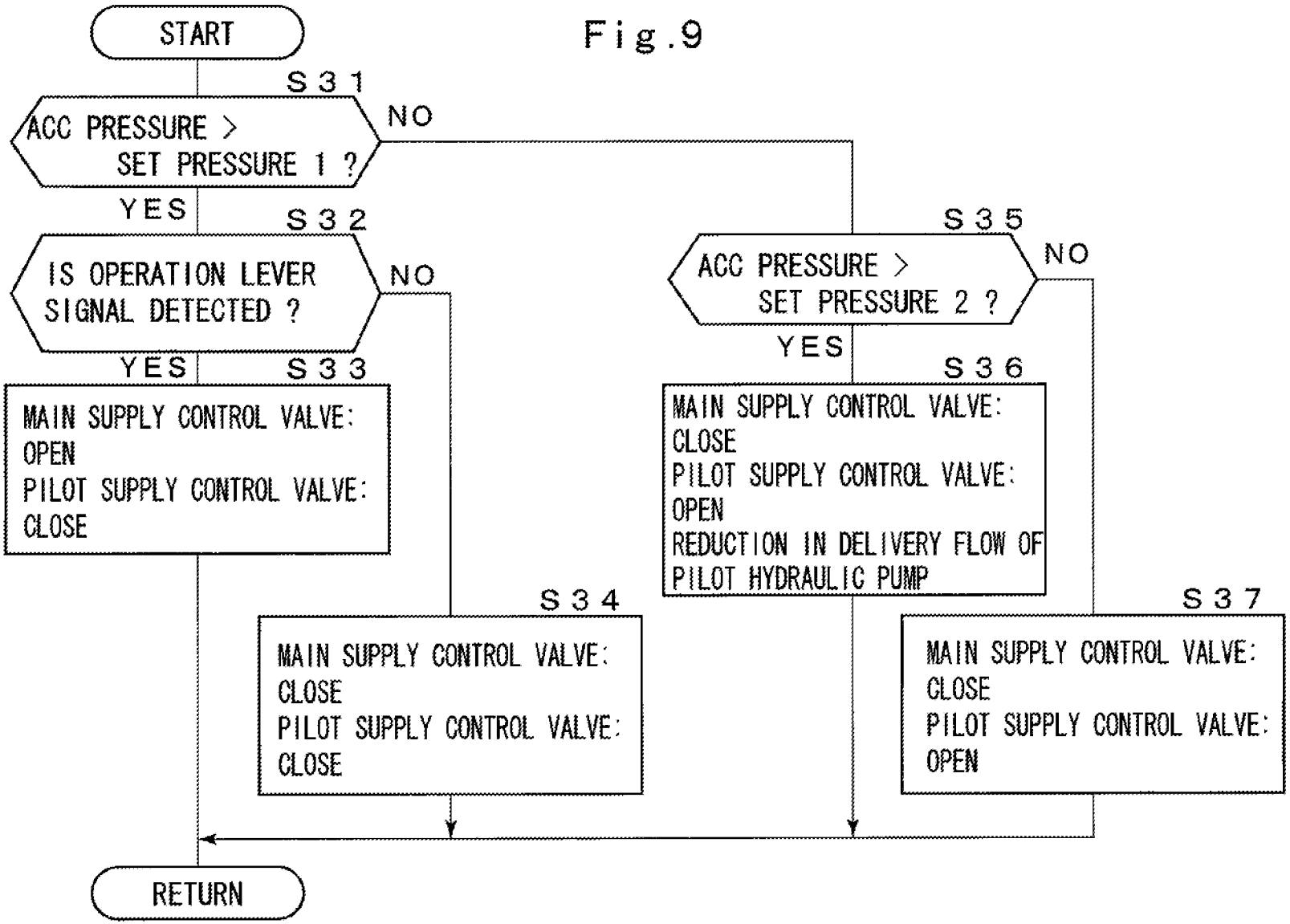
FIG. 9 is a flow chart showing the processing in the controller shown in FIG. 8.

Next, FIG. 8 and FIG. 9 show a fourth embodiment. The fourth embodiment is characterized in that the unloader valve and the non-return valve are omitted and the pilot hydraulic pump is configured of a variable displacement pilot hydraulic pump also serving as a pilot flow reducing device. It should be noted that, in the fourth embodiment, components identical to those in the first embodiment are referred to as identical reference numerals, and an explanation thereof is omitted.

In the aforementioned first embodiment, the pilot hydraulic pump 20 is a fixed displacement hydraulic pump, and also the unloader valve 27 and the check valve 28 are mounted as a pilot flow reducing device in the pilot hydraulic circuit 11B (the pilot delivery line 21). In contrast to this, in the fourth embodiment, the unloader valve 27 and the check valve 28 are omitted and a pilot hydraulic pump 71 is provided as a variable displacement pilot hydraulic pump such as a variable displacement swash-plate hydraulic pump and the like.

In the fourth embodiment, the pilot flow reducing device is configured of the pilot hydraulic pump 71. That is, the pilot hydraulic pump 71 also serves as a pilot flow reducing device. In this case, the pilot hydraulic pump 71 has a regulator (a displacement-variable part and a tilting actuator) 71A for adjustment of a discharge flow rate (a pump displacement). The regulator 71A is variably controlled by a controller 72.

The controller 72 has an input side connected to the accumulator-side pressure sensor 38 and the operation detection sensor 23A. The controller 72 has an output side connected to the main supply control valve 34, the pilot supply control valve 37 and the pilot hydraulic pump 71 (the regulator 71A thereof). The controller 72 controls the opening and closing of the main supply control valve 34, the opening and closing of the pilot supply control valve 37, and the discharge flow rate of the pilot hydraulic pump 71 in accordance with the pressure in the accumulator 29 (the ACC pressure) detected by the accumulator-side pressure sensor 38, and the presence or absence of the operation of the lever operating device 23 detected by the operation detection sensor 23A (the operation lever signal). A memory of the controller 72 has a processing program stored therein to execute the processing flow shown in FIG. 9.

Next, an explanation will be made of the control processing of the controller 72 with reference to FIG. 9. It should be noted that since S31, S32, S35 in FIG. 9 are similar to the processing steps similar to S1, S2, S5 in FIG. 3 in the first embodiment, an explanation thereof is omitted.

When "YES" is determined at S32 and the process goes to S33, in S33, the main supply control valve 34 is switched to the open position and the pilot supply control valve 37 is switched to the closed position. At this time, there is no reduction in the discharge flow rate of the pilot hydraulic pump 71. On the other hand, when "NO" is determined at S32 and the process goes to S34, the main supply control valve 34 and the pilot supply control valve 37 are switched to the closed position. At this time, there is no reduction in the discharge flow rate of the pilot hydraulic pump 71.

When "YES" is determined at S35 and the process goes to S36, in S36, the main supply control valve 34 is switched to the closed position and the pilot supply control valve 37 is switched to the open position. At this time, there is a reduction in the discharge flow rate of the pilot hydraulic pump 71. On the other hand, when "NO" is determined at S35 and the process goes to S37, in S37, the main supply control valve 34 is switched to the closed position and the pilot supply control valve 37 is switched to the open position. At this time, there is no reduction in the discharge flow rate of the pilot hydraulic pump 71.

In the fourth embodiment, the controller 72 as described above controls the main supply control valve 34, the pilot supply control valve 37 and the pilot hydraulic pump 71, and the fourth embodiment does not differ particularly in a basic function from the above-described first embodiment.

In particular, in the fourth embodiment, a variable displacement hydraulic pump is adopted as the pilot hydraulic pump 71. Therefore, when the pressurized oil in the accumulator 29 is being supplied to the low-pressure pilot hydraulic circuit 11B (the pilot delivery line 21), the discharge flow rate of the pilot hydraulic pump 71 is reduced, and thereby, making it possible to achieve efficient utilization of the pressurized oil (the energy) accumulated in the accumulator 29. That is, in the fourth embodiment, without using the unloader valve 27 as in the first embodiment, the pilot hydraulic pump 71 adopts a variable placement hydraulic pump capable of reducing directly the pump flow rate. On this account, the number of valves (switching valves) can be decreased to provide a simple configuration.

Figure 10:
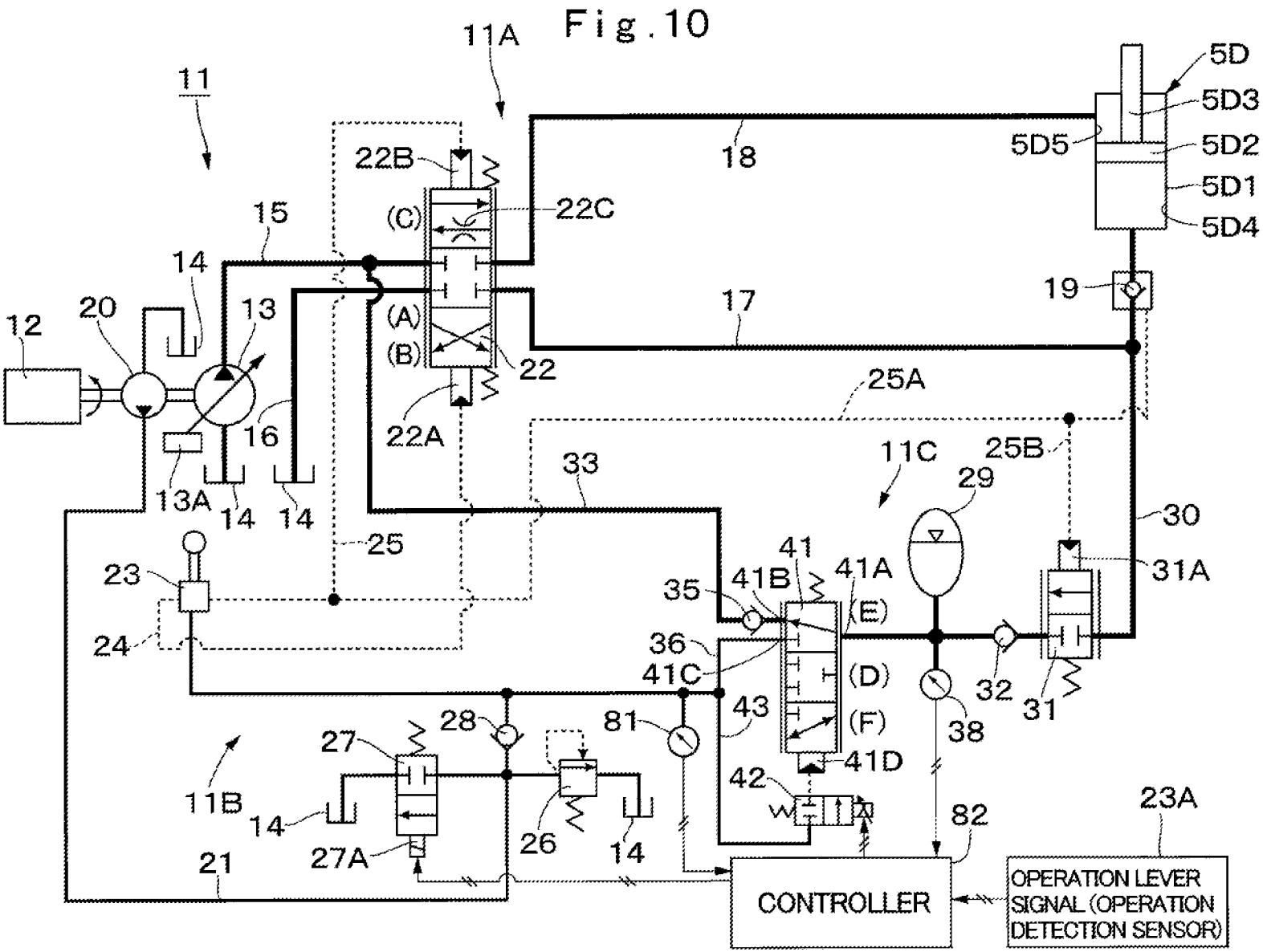
FIG. 10 is a hydraulic circuit diagram of the hydraulic excavator according to a fifth embodiment.
Figure 11:
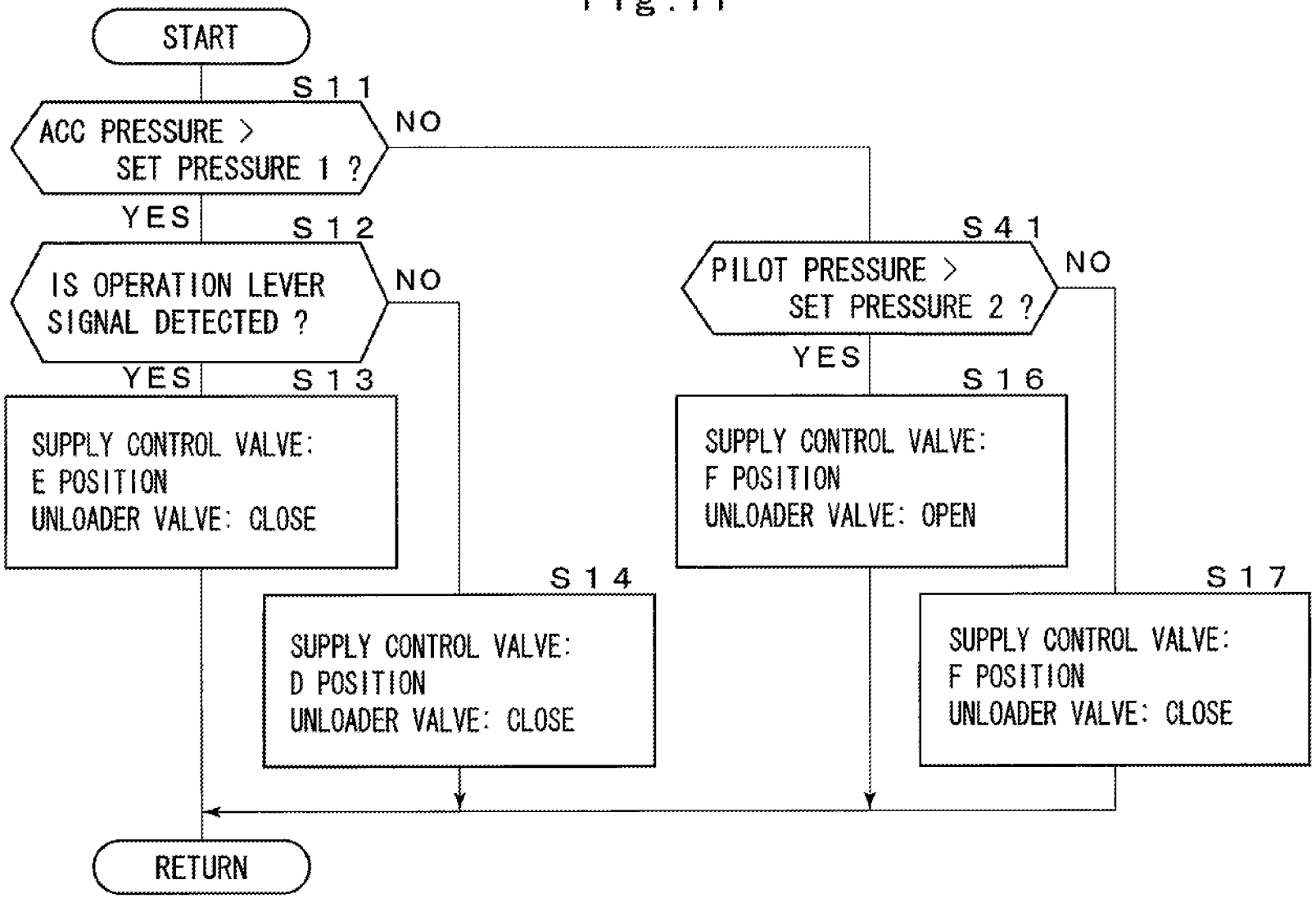
FIG. 11 is a flow chart showing the processing in the controller shown in FIG. 10.

Next, FIG. 10 and FIG. 11 show a fifth embodiment. The fifth embodiment is characterized in including a third pressure detector that detects the pressure in the pilot hydraulic circuit. It should be noted that, in the fifth embodiment, components identical to those in the second embodiment are referred to as identical reference numerals, and an explanation thereof is omitted.

A pilot side pressure sensor 81 is provided in the course of the pilot regeneration line 36. More specifically, the pilot side pressure sensor 81 is provided between a connection part of the pilot regeneration line 36 to the pilot delivery line 21 and the supply control valve 41. The pilot side pressure sensor 81 is a third pressure detector that detects a pressure in the pilot hydraulic circuit 11B (the pilot delivery line 21), more specifically, detects the pressure in the portion of the pilot delivery line 21 downstream of the check valve 28, and also that outputs a detected pressure signal to the controller 82. For this purpose, the pilot side pressure sensor 81 is connected to the controller 82. The pilot side pressure sensor 81 outputs a signal corresponding to the detected pressure, that is, a pilot pressure (a primary pressure) to be supplied to the lever operating device 23, to the controller 82.

The controller 82 has an input side connected to the accumulator-side pressure sensor 38, the pilot side pressure sensor 81 and the operation detection sensor 23A. The controller 82 has an output side connected to the electromagnetic proportional valve 42 and the unloader valve 27. In the fifth embodiment, the controller 82 controls the unloader valve 27 in accordance with the pressure in the accumulator 29 detected by the accumulator-side pressure sensor 38, and the pressure in the pilot delivery line 21 detected by the pilot side pressure sensor 81 (that is, the pilot pressure to be supplied to the lever operating device 23).

Specifically, when the pressure in the accumulator 29 is lower than the preset first set pressure (the set pressure 1) and the pressure in the pilot hydraulic circuit 11B (the pilot delivery line 21) is higher than the second set pressure (the set pressure 2), the controller 82 controls the unloader valve 27 (to the open position) so that the flow rate from the pilot hydraulic pump 20 to the pilot hydraulic circuit 11B is reduced. That is, the comparison between the pressure in the accumulator 29 (the ACC pressure) and the set pressure 2 is performed in the aforementioned first and second embodiment. In contrast to this, in the fifth embodiment, a comparison between the set pressure 2 and the pressure (pilot pressure) in the pilot hydraulic circuit 11B (a portion of the pilot delivery line 21 downstream of the check valve 28) is performed. It should be noted that the set pressure 1 and the set pressure 2 are similar to the set pressure 1 and the set pressure 2 in the first and second embodiments. In addition, the memory of the controller 82 has a processing program stored therein to execute the processing flow shown in FIG. 11.

Next, an explanation will be made of the control processing of the controller 82 with reference to FIG. 11. It should be noted that the flow chart of FIG. 11 is similar to the aforementioned flowchart of FIG. 5 in the second embodiment, except for S41, and the processing at S41 will be explained.

When "YES" is determined at S11 and the process goes to S41, in S41, it is determined whether or not the pilot pressure detected by the pilot side pressure sensor 81 exceeds the set pressure 2 (pilot pressure>set pressure 2). In a case where "YES" is determined at S41, the process goes to S16 to switch the unloader valve 27 to the open position. In a case where "NO" is determined at S41, the process goes to S17 to switch the unloader valve 27 to the closed position.

In the fifth embodiment, the controller 82 as described above uses the pressure (the pilot pressure) detected by the pilot side pressure sensor 81 to control the unloader valve 27, and the fifth embodiment does not differ particularly in a basic function from the above-described second embodiment.

In particular, according to the fifth embodiment, the pressure in the accumulator 29 (the ACC pressure) is lower than the first set pressure (the set pressure 1) and also the pressure (the pilot pressure) in the pilot hydraulic circuit 11B (a portion of the pilot delivery line 21 downstream of the check valve 28) is higher than the second set pressure (the set pressure 2), the output of the pilot hydraulic pump 20 can be reduced. This enables a reduction in consumption of power (fuel) of the drive source (for example, the engine 12) of the pilot hydraulic pump 20.

Here, the second set pressure (the set pressure 2) is set as a pressure required in the pilot hydraulic circuit 11B (a pressure required for the lever operating device 23). However, for example, in the second embodiment, since the comparison between the pressure in the accumulator 29 (the ACC pressure) and the second set pressure (the set pressure 2) is performed, a deviation corresponding to a pressure loss in the supply control valve 41 may possibly occur. In contrast to this, in the fifth embodiment, the pressure in the pilot hydraulic circuit 11B (a portion of the pilot delivery line 21 downstream of the check valve 28) detected by the pilot side pressure sensor 81 is directly compared, and therefore, an accurate determination about the opening or closing of the unloader valve 27 can be performed. Thereby, the pressure in the pilot hydraulic circuit 11B (the pressure required to be supplied to the lever operating device 23) can be ensured with more accuracy.

Figure 12:
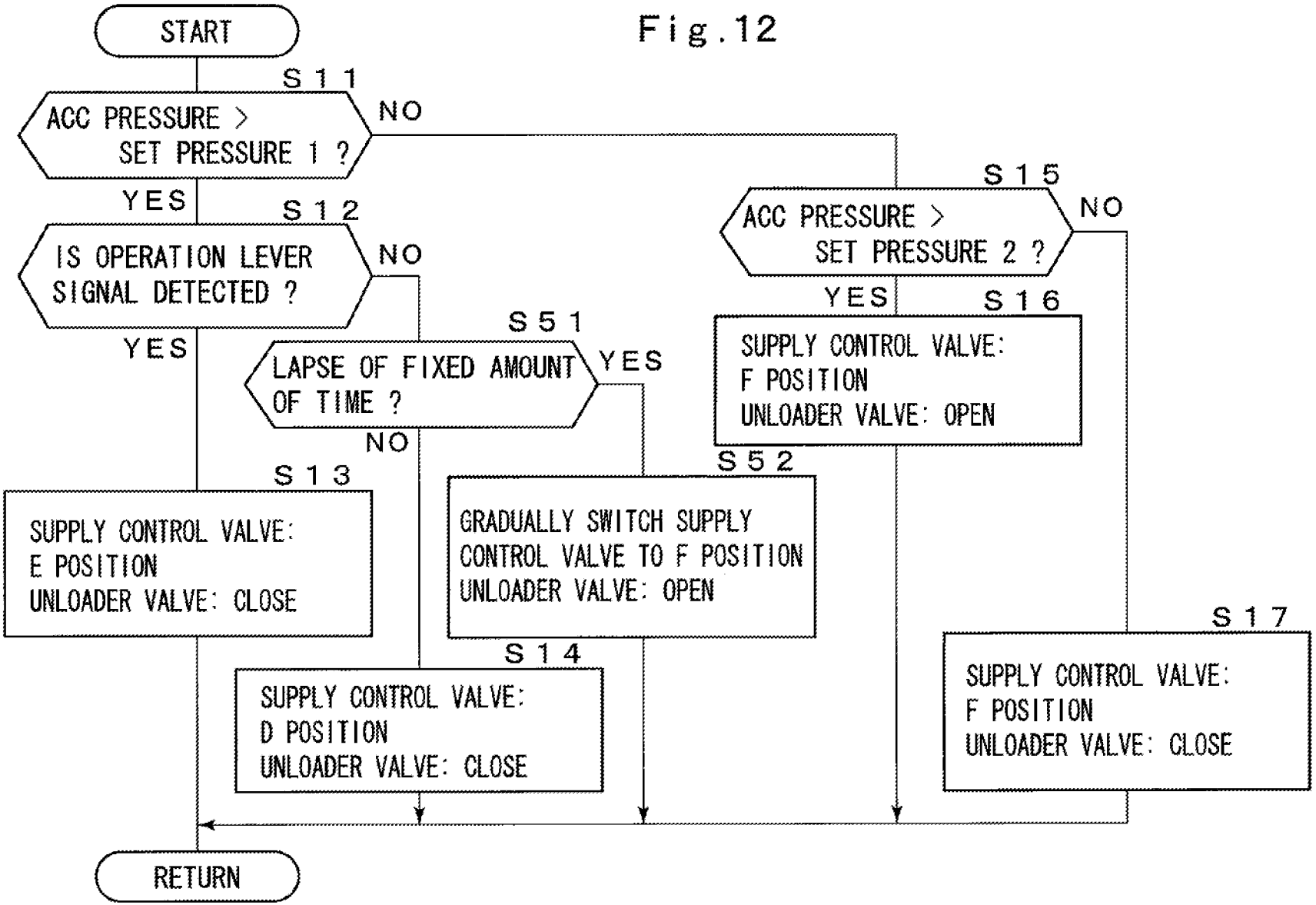
FIG. 12 is a flow chart showing the processing in the controller according to a sixth embodiment.

Next, FIG. 12 shows a sixth embodiment. The sixth embodiment is characterized in the configuration in which, even when a pressure in an accumulator is higher than a first set pressure, the pressurized oil in the accumulator is supplied to a pilot hydraulic circuit after the elapse of a predetermined amount of time. It should be noted that, in the sixth embodiment, components identical to those in the second embodiment are referred to as identical reference numerals, and an explanation thereof is omitted.

For example, in the aforementioned second embodiment, at S12 in FIG. 5, when the operation lever signal is not detected (the lever operating device 23 is not operated), there is no destination of the pressurized oil in the accumulator 29, so that the supply control valve 41 is maintained in the switch position (D). In this situation, since the pressurized oil in the accumulator 29 is under high pressure, it is difficult to establish the connection to the pilot hydraulic circuit 11B (a portion of the pilot delivery line 21 downstream of the check valve 28) without any change. To avoid this, as far as the operation lever signal is detected, the accumulator 29 is not connected to any line or component. As a result, the accumulator 29 may possibly not be sufficiently utilized.

In contemplation of this, in the sixth embodiment, even when the pressure in the accumulator 29 is higher than the preset first set pressure (the set pressure 1) after the lapse of a predetermined amount of time, the controller 44 (see FIG. 4) controls the supply control valve 41 such that the pressurized oil in the accumulator 29 is supplied to the pilot hydraulic circuit 11B (a portion of the pilot delivery line 21 downstream of the check valve 28). That is, even when the pressure in the accumulator 29 exceeds the set pressure 1 after the lapse of a predetermined amount of time, the controller 44 controls the supply control valve 41 serving as the pilot circuit supply device such that the supply control valve 41 gradually switches to the switch position (F). The memory of the controller 44 has a processing program stored therein to execute the processing flow shown in FIG. 12.

Next, an explanation will be made of the control processing of the controller 44 with reference to FIG. 12. It should be noted that the flowchart of FIG. 12 is shown by adding S51 and S52 to the aforementioned flow chart of FIG. 5 in the second embodiment, and therefore, the processing at S51 and S52 will be described.

In a case where "NO" is determined at S12, that is, in a case where it is determined that the operation lever signal is not detected, the process goes to S51. At S51, it is determined whether or not a fixed amount of time has passed from the time of determining "NO" at S12. That is, it is determined at S51 whether or not the time during which "NO" is repeatedly determined at S12 (repetition duration amount of time) exceeds the fixed amount of time. The fixed amount of time (the predetermined amount of time) refers to a determination time to determine the start of reduction in pressure in the accumulator 29. For example, the fixed time is preset through experiments, calculations, simulations and the like such that the amount of time that allows the pressurized oil in the accumulator 29 to be efficiently utilized is obtained even when the lever operating device 23 is not operated for a long time.

In a case where "NO" is determined at S51, that is, in a case where the fixed amount of time has not elapsed, the process goes to S14. On the contrary, in a case where "YES" is determined at S51, that is, in a case where the fixed amount of time has elapsed, the process goes to S52. At S52, the supply control valve 41 is switched gradually to the switch position (F) and the unloader valve 27 is switched to the open position. That is, the controller 44 outputs an instruction to the electromagnetic proportional valve 42 such that the supply control valve 41 switches gradually to the switch position (F). Thereby, the pressure in the accumulator 29 gradually reduces, so that even when the lever operating device 23 is not operated for a long time, "NO" is determined at S11 to allow the process to go to S15.

In this manner, in the sixth embodiment, because of addition of S51 and S52, in a case where the time during which the accumulator 29 cannot be connected to anywhere has elapsed beyond the predetermined amount of time, the process goes to S52, the accumulator 29 is connected to the pilot hydraulic circuit 11B to assist the flow rate of the pilot hydraulic pump 20. In step with this, the unloader valve 27 is opened to reduce the load on the pilot hydraulic pump 20. Thereby, a reduction in fuel consumption of the engine 12 is made possible. In addition, by virtue of the processing, the pressure in the accumulator 29 decreases, and therefore, the process goes from S11 to S15, so that the accumulator 29 is connected to the pilot hydraulic circuit 11B at all times. In addition, when a pressure drop in the pilot hydraulic circuit 11B occurs, the unloader valve 27 is closed for accumulation in (charging of) the accumulator 29. Then, after a sufficient accumulation, the unloader valve 27 is opened to reduce the load on the pilot hydraulic pump 20. This enables a reduction in fuel consumption of the engine 12. Further, at S52, the supply control valve 41 is gradually opened, that is, switched gradually to the switch position (F). Thereby, the accumulator 29 is connected to the pilot hydraulic circuit 11B while a pressure loss is appropriately allowed for the pressurized oil in the accumulator 29 under high pressure. This enables suppression of an excessive rise in pressure in the pilot hydraulic circuit 11B.

In the sixth embodiment, the processing as shown above in FIG. 12 is performed in the controller 44, and the sixth embodiment does not differ particularly in a basic function from the above-described second embodiment. In particular, according to the sixth embodiment, even when the accumulator 29 is continuously under high pressure, upon lapse of a predetermined (fixed) amount of time, the pressurized oil in the accumulator 29 is supplied to the pilot hydraulic circuit 11B. As a result, the pressure (the energy) in the accumulator 29 can be effectively utilized.

Figure 13:
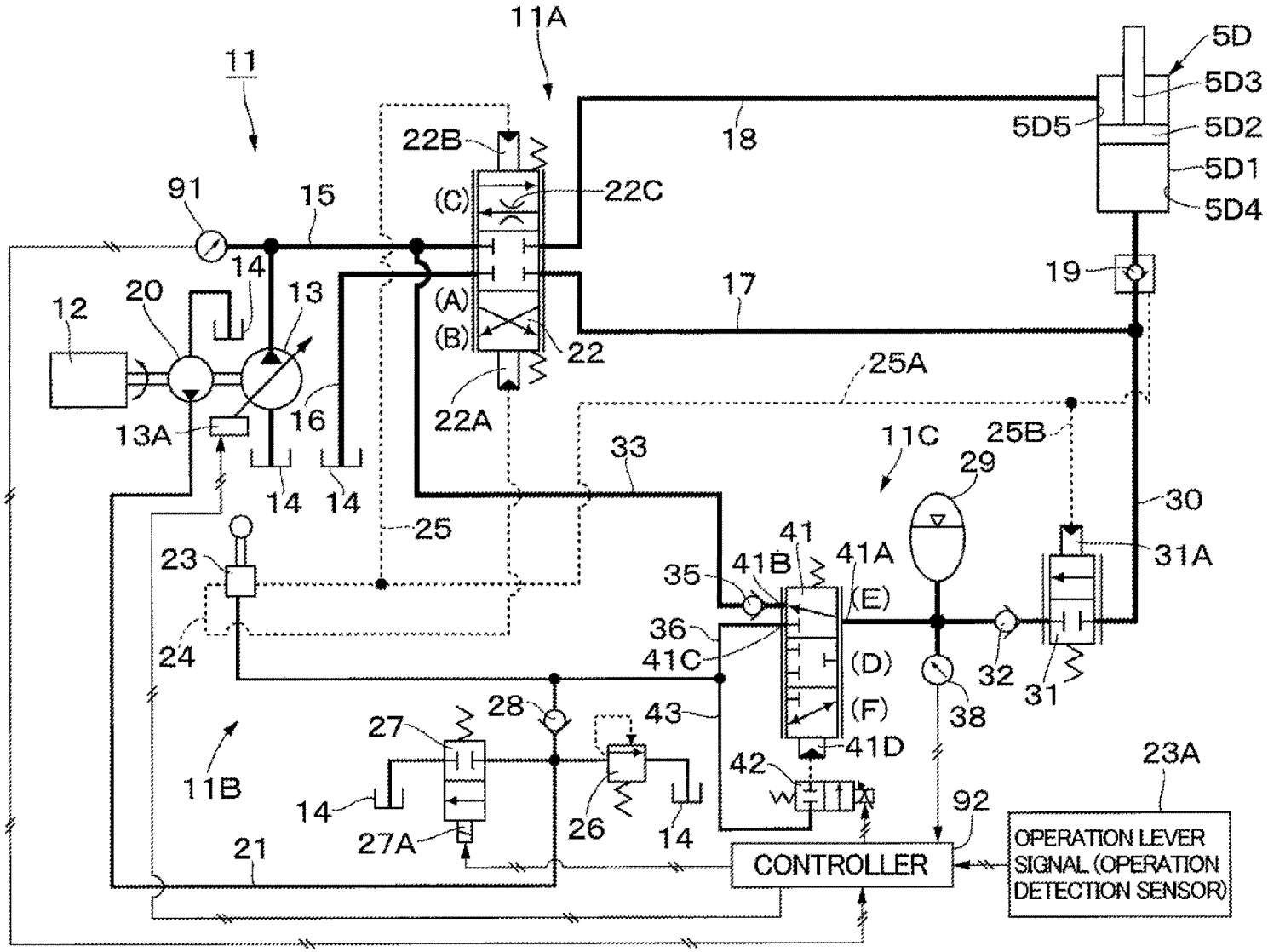
FIG. 13 is a hydraulic circuit diagram of the hydraulic excavator according to a seventh embodiment.
Figure 14:
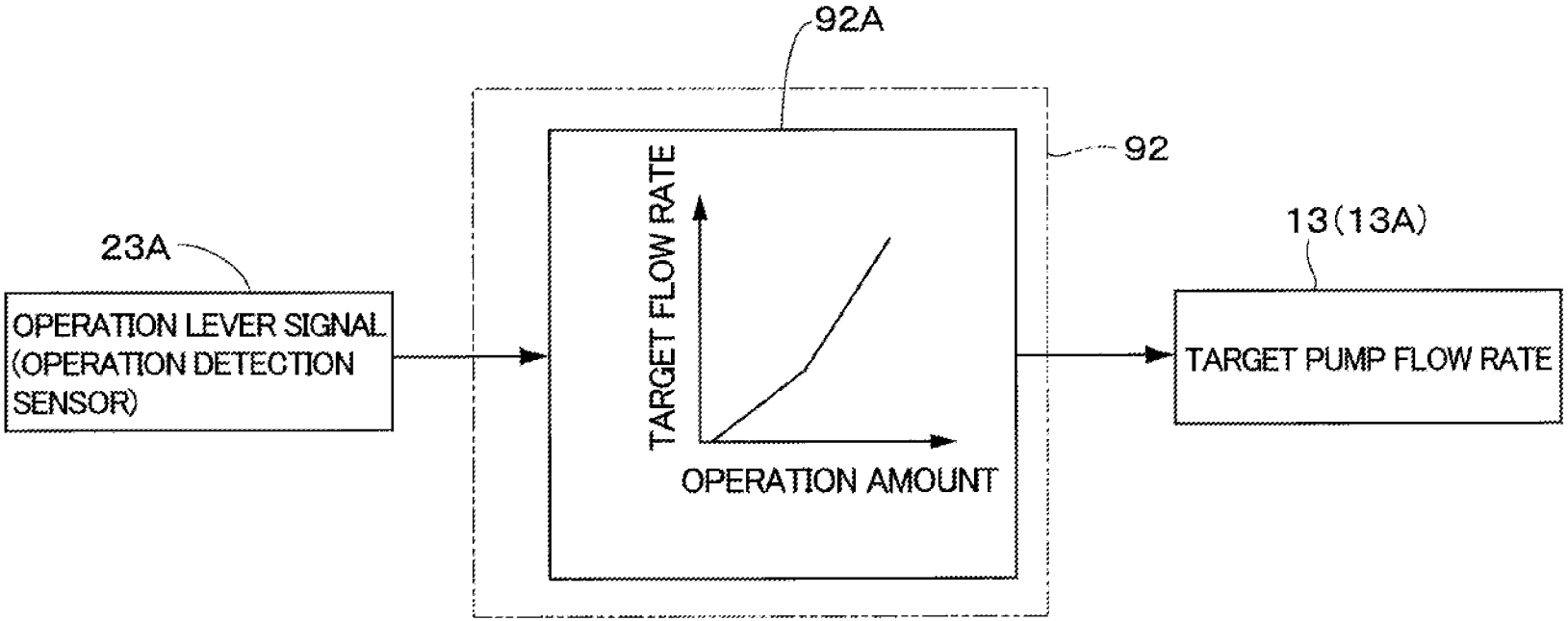
FIG. 14 is a block diagram showing the processing of calculating a target pump flow rate from an operation lever signal.
Figure 15:
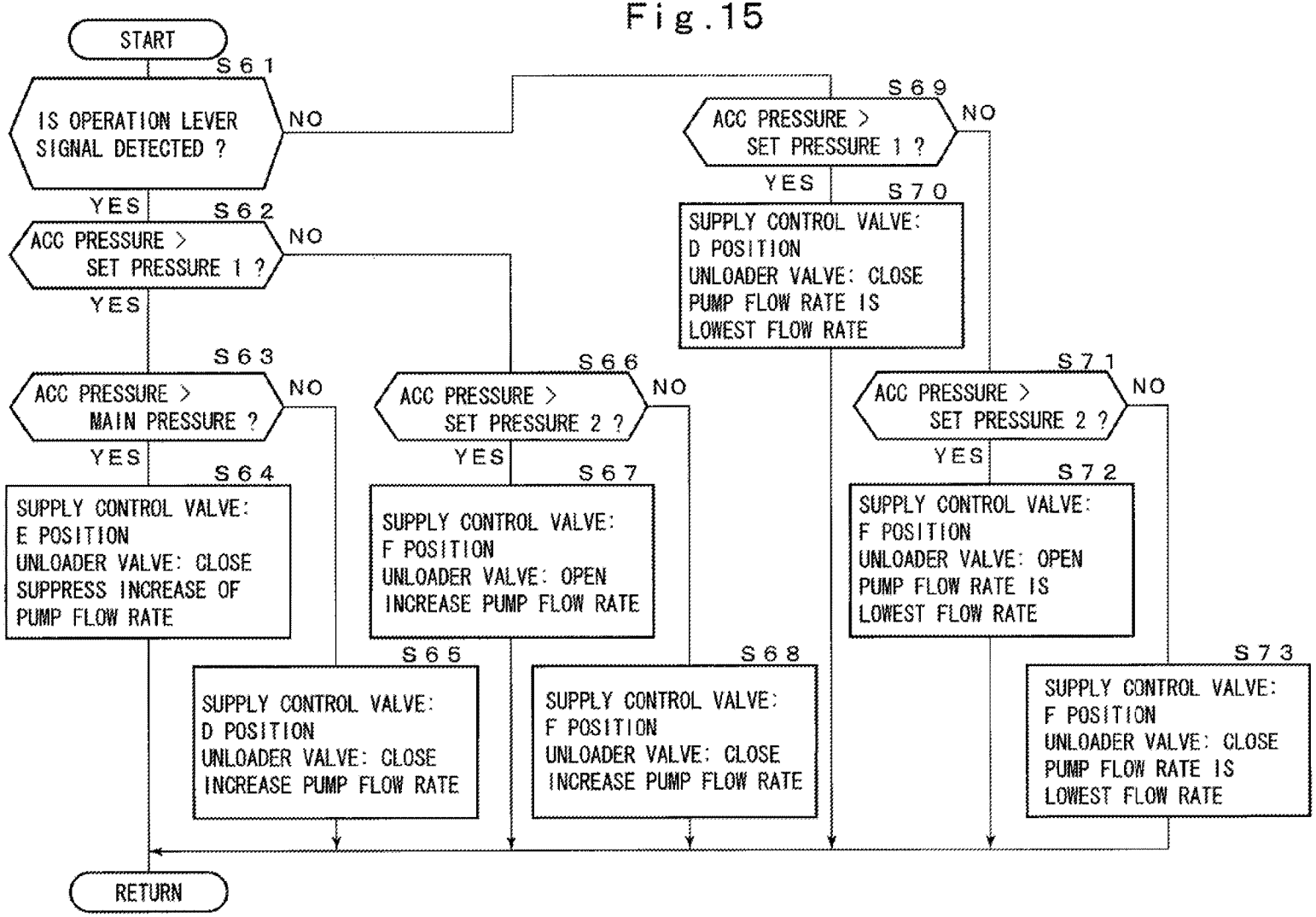
FIG. 15 is a flow chart showing the processing in the controller shown in FIG. 13.

Next, FIGS. 13 to 15 show a seventh embodiment. The seventh embodiment is characterized in the configuration in which a variable displacement main hydraulic pump is controlled in accordance with a pressure in an accumulator and a pressure in a main hydraulic circuit (that is, a flow rate of the main hydraulic pump is reduced when the pressurized oil in the accumulator is supplied to the main hydraulic circuit side). It should be noted that, in the seventh embodiment, components identical to those in the second embodiment are referred to as identical reference numerals, and an explanation thereof is omitted.

The main hydraulic pump 13 is, as similar to each of the above-described embodiments, configured of a variable displacement hydraulic pump, more specifically, a variable displacement swash-plate type, a variable displacement bent-axis type or a variable displacement radial-piston type hydraulic pump. That is, the main hydraulic pump 13 has a regulator (a displacement-variable part or a tilting actuator) 13A for adjustment of a discharge flow rate (a pump displacement). The regulator 13A is connected to a controller 92 to be variably controlled by the controller 92. In this manner, the main hydraulic pump 13 is included in each of the aforementioned embodiments and is configured of a variable displacement pump, that is, a variable displacement main hydraulic pump a discharge flow rate of which is variably controlled by the controller 92.

A main side pressure sensor 91 is mounted in the main delivery line 15. More specifically, the main side pressure sensor 91 is provided between a delivery port of the main hydraulic pump 13 and the directional control valve 22. The main side pressure sensor 91 serves as a second pressure detector that detects the pressure in the main hydraulic circuit 11A (the main delivery line 15) and outputs the detected pressure signal to the controller 92. For this purpose, the main side pressure sensor 91 is connected to the controller 92, and outputs a signal corresponding to the detected pressure, that is, the pressure in the main hydraulic pump 13 to the controller 92.

The controller 92 has an input side connected to the accumulator-side pressure sensor 38, the operation detection sensor 23A and the main side pressure sensor 91. The controller 92 has an output side connected to the electromagnetic proportional valve 42, the unloader valve 27 and the main hydraulic pump 13 (the regulator 13A thereof). The controller 92 controls the discharge flow rate of the main hydraulic pump 13 in accordance with the operation amount (the operation lever signal) of the lever operating device 23, the pressure in the accumulator 29 detected by the accumulator-side pressure sensor 38, and the pressure in the main delivery line 15 detected by the main side pressure sensor 91.

Here, as shown in FIG. 14, in the controller 92, when an operation lever signal corresponding to the lever operation amount is received from the operation detection sensor 23A as an input, the operation lever signal is sent to a function generator 92A. The function generator 92A calculates a pump flow rate (a target pump flow rate) in accordance with the operation lever signal, and then outputs a target flow rate signal corresponding to the pump flow rate to the main hydraulic pump 13 (the regulator 13A). The main hydraulic pump 13 delivers the pressurized oil at a pump flow rate based on the target flow rate signal. The function generator 92A calculates the target flow rate signal such that, for example, the larger the lever operation amount, the more the pump flow rate increases (rises). Hence, as the lever operation amount is larger, the pump flow rate (the target pump flow rate) increases the more, and thus, making it possible to increase the speed of the hydraulic cylinder 5D. In short, the movement desired by the operator can be realized.

Further, the controller 92 controls the supply control valve 41, the unloader valve 27 and the main hydraulic pump 13 in accordance with the presence or absence of the operation of the lever operating device 23 (the operation lever signal), the pressure in the accumulator 29 (the ACC pressure) detected by the accumulator-side pressure sensor 38, and the pressure in the main hydraulic circuit 11A (the main pressure) detected by the main side pressure sensor 91. That is, in the seventh embodiment the controller 92 controls the discharge flow rate of the variable displacement main hydraulic pump 13 in accordance with the pressure in the accumulator 29 (the ACC pressure) and the pressure in the main hydraulic circuit (the main delivery line 15) (the main pressure). The memory of the controller 92 has a processing program stored therein to execute the processing flow shown in FIG. 15.

Next, an explanation will be made of the control processing of the controller 92 with reference to FIG. 15.

Upon start of computation in the controller 92, the controller 92 determines at S61 whether or not the lever operating device 23 is operated (whether or not the operation lever signal is detected). That is, it is determined at S61 whether or not the pressurized oil in the accumulator 29 is allowed to be supplied to the main hydraulic circuit 11A (the main delivery line 15)-side, based on the operation lever signal. In a case where there is no input of the operation lever signal, this means the condition in which the hydraulic cylinder 5D is not working. In this state, even when the pressure in the accumulator 29 is supplied to the main hydraulic circuit 11A (the main delivery line 15)-side, the effective use of energy (the pressurized oil) may possibly not be provided. To address this, at S61 it is determined whether or not the operation lever signal is detected. Then, in a case where the operation lever signal is not detected, the process goes to S69, and in a case where the operation lever signal is detected, the process goes to S62.

When "YES" is determined at S61, the process goes to S62. It is determined at S62 whether or not the ACC pressure which is the pressure in the accumulator 29 exceeds the set pressure 1 (ACC pressure>set pressure 1). In a case where "YES" is determined at S62, the process goes to S63. In a case where "NO" is determined at S62, the process goes to S66. At S63, it is determined whether or not the ACC pressure exceeds the main pressure (the pressure in the main hydraulic circuit 11A detected by the main side pressure sensor 91) (ACC pressure>main pressure).

When "YES" is determined at S63, the process goes to S64. At S64, the supply control valve 41 is switched to the switch position (E), and the unloader valve 27 is switched to the closed position. In step with this, a rise (an increase) in flow rate of the main hydraulic pump 13 is suppressed. That is, the pressurized oil in the accumulator 29 is supplied to the main hydraulic circuit 11A (the main delivery line 15)-side, and also the pump flow rate of the main hydraulic pump 13 is lowered even in an increase in a lever operation amount (the operation lever signal). In relation to how much the pump flow rate is suppressed, the pump flow rate may be reduced according to a fixed ratio, or alternatively may be adjusted by using a differential pressure between the ACC pressure and the main pressure. In the latter case, the higher the differential pressure between the ACC pressure and the main pressure, typically the more the flow rate increases. Therefore, when the differential pressure is high, the pump flow rate can be suppressed as much as possible.

On the other hand, when "NO" is determined at S63, the process goes to S65. At S65, the supply control valve 41 is switched to the switch position (D), and the unloader valve 27 is switched to the closed position. In step with this, the flow rate of the main hydraulic pump 13 is raised (increased) in accordance with the operation lever signal (the lever operation amount). That is, when the ACC pressure is low, even when the supply control valve 41 is switched to the switch position (E), the pressurized oil is not supplied from the accumulator 29 to the main hydraulic circuit 11A (the main delivery line 15)-side. Consequently, the supply control valve 41 is closed (switched to the switch position (D)).

On the contrary, in a case where "NO" is determined at S62, that is, in a case where it is determined that the ACC pressure is low, which is equal to or lower than the set pressure 1 and the accumulator 29 should be connected to the pilot hydraulic circuit 11B (the pilot delivery line 21) to make energy utilization more efficient, the process goes to S66. At S66, it is determined whether or not the ACC pressure is higher than the set pressure 2. When "YES" is determined at S66, the process goes to S67 to switch the supply control valve 41 to the switch position (F) and switch the unloader valve 27 to the open position. In step with this, the flow rate of the main hydraulic pump 13 is raised (increased) in accordance with the operation lever signal (the lever operation amount). On the other hand, when "NO" is determined at S66, the process goes to S68 to switch the supply control valve 41 to the switch position (F) and switch the unloader valve 27 to the closed position. In step with this, the flow rate of the main hydraulic pump 13 is raised (increased) in accordance with the operation lever signal (the lever operation amount).

When "NO" is determined at S61, that is, in a case where it is determined that the operation lever signal is not detected, the process goes to S69. As similar to S62, it is determined at S69 whether or not the ACC pressure is higher than the set pressure 1. When "YES" is determined at S69, the pressure in the accumulator 29 is higher than the set pressure 1 but the lever operating device 23 is not operated. Because of this, there is no timing for returning the pressurized oil to the main hydraulic circuit 11A (the main delivery line 15)-side. Hence, the process goes to S70 to switch the supply control valve 41 to the switch position (D) and switch the unloader valve 27 to the closed position. In step with this, the flow rate of the main hydraulic pump 13 becomes a lowest flow rate since the operation lever signal is not input.

In a case where "NO" is determined at S69, the process goes to S71. As similar to S66, it is determined at S71 whether or not the ACC pressure is higher than the set pressure 2. When "YES" is determined at S71, the process goes to S72 to switch the supply control valve 41 to the switch position (F) and switch the unloader valve 27 to the open position. In step with this, the flow rate of the main hydraulic pump 13 becomes a lowest flow rate since the operation lever signal is not input. When "NO" is determined at S71, the process goes to S73 to switch the supply control valve 41 to the switch position (F) and switch the unloader valve 27 to the closed position. In step with this, the flow rate of the main hydraulic pump 13 becomes a lowest flow rate since the operation lever signal is not input.

In the seventh embodiment, the controller 92 as described above controls the supply control valve 41, the unloader valve 27 and the main hydraulic pump 13, and the seventh embodiment does not differ particularly in a basic function from the above-described second embodiment. In particular, according to the seventh embodiment, the controller 92 controls the discharge flow rate of the variable displacement main hydraulic pump 13 in accordance with the pressure in the accumulator 29 (the ACC pressure) detected by the accumulator-side pressure sensor 38 and the pressure in the main hydraulic circuit 11A (the main delivery line 15) (the main pressure) detected by the main side pressure sensor 91. Therefore, the discharge flow rate of the main hydraulic pump 13 can be lowered in accordance with the pressure in the accumulator 29 (the ACC pressure) and the pressure in the main hydraulic circuit 11A (the main pressure), and thus, the pressurized oil (the energy) in the accumulator 29 can be more efficiently utilized. In other words, the supply control valve 41, the unloader valve 27 and the main hydraulic pump 13 can be more minutely controlled in accordance with the ACC pressure and the main pressure. In consequence, a further reduction in fuel consumption (further enhancement in fuel efficiency) can be achieved.

It should be noted that, the embodiments other than the third embodiment are explained by taking a case where the pressurized oil in the accumulator 29 is returned to the main delivery line 15 of the main hydraulic circuit 11A, that is, to the exit side (the outlet side and the downstream side) of the main hydraulic pump 13, 71, as an example. In addition, the third embodiment is explained by taking a case where the pressurized oil of the accumulator 29 is returned to the bottom side line 17 of the main hydraulic circuit 11A, that is, the hydraulic cylinder 5D (the bottom-side oil chamber 5D4 thereof) from which the pressurized oil is recovered, as an example.

However, without limitation to this, the pressurized oil in the accumulator 29 may be returned to any place as long as it is returned to the main hydraulic circuit 11A under high pressure. For example, the pressurized oil may be configured to be returned to another hydraulic actuator such as the arm cylinder 5E, the bucket cylinder 5F and the like. In addition, as regards the hydraulic actuator from which the pressurized oil is recovered, without limitation to the boom cylinder 5D, the pressurized oil may be configured to be recovered (accumulated) from another hydraulic actuator such as the arm cylinder 5E, the bucket cylinder 5F and the like, into the accumulator 29.

Each of the above embodiments is explained by taking a case where the pilot hydraulic pump 20 is driven by the engine 12, as an example. However, without limitation to this, for example, the pilot hydraulic pump may be driven by an electric motor, separately from the main hydraulic pump. In this case, when the pressurized oil is supplied from the accumulator to the pilot hydraulic circuit, the rotation of the electric motor can be decelerated or stopped.

Each of the above embodiments is explained by taking the engine-operated hydraulic excavator 1 driven by the engine 12 as an example of the construction machine. However, without limitation to this, the present invention is applicable to, for example, a hybrid hydraulic excavator driven by an engine and an electric motor, as well as an electrically powered hydraulic excavator. Further, the present invention is not limited to the hydraulic excavator, but may be widely applied to a variety of construction machines such as a wheel loader, a hydraulic crane, a bulldozer and the like. Further, it should be understood that the embodiments having described above are merely illustrative of the present invention, and any partial substitution and any combination of the components shown in the different embodiments can be made possible.

DESCRIPTION OF REFERENCE NUMERALS

1: Hydraulic excavator (Construction machine)
5D: Boom cylinder (Hydraulic actuator)
5E: Arm cylinder (Hydraulic actuator)
5F: Bucket cylinder (Hydraulic actuator)
11A: Main hydraulic circuit
11B: Pilot hydraulic circuit
13: Main hydraulic pump
20: Pilot hydraulic pump
27: Unloader valve (Pilot flow reducing device)
28: Check valve (Non-return valve)
29: Accumulator (Accumulator)
31: Recovery control valve (Recovery device, first control valve)

34: Main supply control valve (Main circuit supply device, Second control valve)

37: Pilot supply control valve (Pilot circuit supply device, Third control valve)

38: Accumulator-side pressure sensor (First pressure detector)

39, 44, 62, 72, 82, 92: Controller (Control device)

41: Supply control valve (Main circuit supply device, Pilot circuit supply device, First directional control valve, First connection position, Second connection position, Block position)

51: Recovery supply control valve (Recovery device, Main circuit supply device, Pilot circuit supply device, Second directional control valve, Third connection position, Fourth connection position, Block position)

71: Pilot hydraulic pump (Pilot flow reducing device)

81: Pilot side pressure sensor (Third pressure detector)

91: Main side pressure sensor (Second pressure detector)

The invention claimed is:

1. A construction machine comprising:

a main hydraulic pump that supplies pressurized oil to a main hydraulic circuit including a hydraulic actuator;

a pilot hydraulic pump that supplies pressurized oil to a pilot hydraulic circuit to operate the hydraulic actuator; and an accumulator that accumulates pressurized oil discharged from the hydraulic actuator, wherein the construction machine further comprises:

a recovery device that recovers the pressurized oil discharged from the hydraulic actuator into the accumulator;

a main circuit supply device that supplies pressurized oil accumulated in the accumulator to the main hydraulic circuit;

a pilot circuit supply device that supplies the pressurized oil accumulated in the accumulator to the pilot hydraulic circuit; and a control device that determines which one of the main hydraulic circuit and the pilot hydraulic circuit is subjected to the pressurized oil accumulated in the accumulator, and also controls the main circuit supply device and the pilot circuit supply device based on the determination.

2. A construction machine comprising:

a main hydraulic pump that supplies pressurized oil to a main hydraulic circuit including a hydraulic actuator;

a pilot hydraulic pump that supplies pressurized oil to a pilot hydraulic circuit to operate the hydraulic actuator; and an accumulator that accumulates pressurized oil discharged from the hydraulic actuator, wherein the construction machine further comprises:

a recovery device that recovers the pressurized oil discharged from the hydraulic actuator into the accumulator;

a main circuit supply device that supplies pressurized oil accumulated in the accumulator to the main hydraulic circuit;

a pilot circuit supply device that supplies the pressurized oil accumulated in the accumulator to the pilot hydraulic circuit; and the recovery device includes a first control valve to switch connection and block between the hydraulic actuator and the accumulator, and wherein:

the main circuit supply device and the pilot circuit supply device include a first directional control valve that is switched to any one of a first connection position that connects the accumulator and the main hydraulic circuit to each other, a second connection position that connects the accumulator and the pilot hydraulic circuit to each other, and a block position that breaks connection between the accumulator, the main hydraulic circuit, and the pilot hydraulic circuit.

3. A construction machine comprising:

a main hydraulic pump that supplies pressurized oil to a main hydraulic circuit including a hydraulic actuator;

a pilot hydraulic pump that supplies pressurized oil to a pilot hydraulic circuit to operate the hydraulic actuator; and an accumulator that accumulates pressurized oil discharged from the hydraulic actuator, wherein the construction machine further comprises:

a recovery device that recovers the pressurized oil discharged from the hydraulic actuator into the accumulator;

a main circuit supply device that supplies pressurized oil accumulated in the accumulator to the main hydraulic circuit;

a pilot circuit supply device that supplies the pressurized oil accumulated in the accumulator to the pilot hydraulic circuit, and wherein:

the recovery device, the main circuit supply device, and the pilot circuit supply device are configured of a second directional control valve as a single directional control valve, and the second directional control valve is switched to any one of a third connection position that connects the hydraulic actuator and the accumulator to each other, a fourth connection position that connects the accumulator and the pilot hydraulic circuit to each other, and a block position that breaks connection between the accumulator, the hydraulic actuator, and the pilot hydraulic circuit.

4. The construction machine according to claim 1, wherein:

the recovery device includes a first control valve to switch connection and block between the hydraulic actuator and the accumulator, the main circuit supply device includes a second control valve to switch connection and block between the accumulator and the main hydraulic circuit, and the pilot circuit supply device includes a third control valve to switch connection and block between the accumulator and the pilot hydraulic circuit.

5. The construction machine according to claim 1, further comprising:

a pilot flow reducing device capable of reducing a flow rate from the pilot hydraulic pump to the pilot hydraulic circuit.

6. The construction machine according to claim 5, wherein:

the pilot flow reducing device includes an unloader valve that is provided between the pilot hydraulic pump and the pilot hydraulic circuit and that discharges pressurized oil delivered from the pilot hydraulic pump into a tank, a non-return valve is mounted between the unloader valve and the pilot hydraulic circuit to block pressurized oil in the pilot hydraulic circuit side from flowing into the unloader valve side, and the pressurized oil in the accumulator is caused to flow from the pilot circuit supply device to a portion of the pilot hydraulic circuit downstream of the non-return valve.

7. The construction machine according to claim 5, wherein:

the pilot hydraulic pump includes a variable displacement pilot hydraulic pump, and the variable displacement pilot hydraulic pump also serves as the pilot flow reducing device.

8. The construction machine according to claim 1, further comprising:

a first pressure detector that detects a pressure in the accumulator and then outputs a pressure signal indicative of the detected pressure to the control device, wherein:

the control device controls the main circuit supply device and the pilot circuit supply device in accordance with the pressure in the accumulator detected by the first pressure detector.

9. The construction machine according to claim 8, wherein:

the control device controls, when the pressure in the accumulator is higher than a preset first set pressure, the main circuit supply device to supply the pressurized oil in the accumulator to the main hydraulic circuit, and when the pressure in the accumulator is lower than the preset first set pressure, the pilot circuit supply device to supply the pressurized oil in the accumulator to the pilot hydraulic circuit.

10. The construction machine according to claim 9, wherein:

even when the pressure in the accumulator is higher than the preset first set pressure, the control device controls the pilot circuit supply device to supply the pressurized oil in the accumulator to the pilot hydraulic circuit after elapse of a predetermined amount of time.

11. The construction machine according to claim 8, further comprising:

a second pressure detector that detects a pressure in the main hydraulic circuit and then outputs a pressure signal indicative of the detected pressure to the control device, wherein:

the main hydraulic pump includes a variable displacement main hydraulic pump a discharge flow rate of which is variably controlled by the control device, and the control device controls the variable displacement main hydraulic pump in accordance with the pressure in the accumulator and the pressure in the main hydraulic circuit.

12. The construction machine according to claim 8, further comprising:

a pilot flow reducing device capable of reducing a flow rate from the pilot hydraulic pump to the pilot hydraulic circuit, wherein:

when the pressure in the accumulator is lower than a preset first set pressure and also higher than a preset second set pressure, which is set lower than the first set pressure, the control device controls the pilot flow reducing device to reduce a flow rate to the pilot hydraulic circuit.

13. The construction machine according to claim 8, further comprising:

a pilot flow reducing device capable of reducing a flow rate from the pilot hydraulic pump to the pilot hydraulic circuit; and a third pressure detector that detects a pressure in the pilot hydraulic circuit and then outputs a pressure signal indicative of the detected pressure to the control device, wherein:

when the pressure in the accumulator is lower than a preset first set pressure and also the pressure in the pilot hydraulic circuit is higher than a preset second set pressure, which is set lower than the first set pressure, the control device controls the pilot flow reducing device to reduce a flow rate to the pilot hydraulic circuit.

* * * * *